US007257342B2

(12) United States Patent
Hayakawa et al.

(10) Patent No.: US 7,257,342 B2
(45) Date of Patent: Aug. 14, 2007

(54) IMAGE FORMING APPARATUS

(75) Inventors: Akira Hayakawa, Shizuoka (JP); Masaru Tsukada, Shizuoka (JP); Taro Ishifune, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/407,040

(22) Filed: Apr. 20, 2006

(65) Prior Publication Data

US 2006/0188280 A1 Aug. 24, 2006

Related U.S. Application Data

(62) Division of application No. 10/806,197, filed on Mar. 23, 2004, now Pat. No. 7,218,873.

(30) Foreign Application Priority Data

Mar. 31, 2003 (JP) ..... 2003-095219
Mar. 31, 2003 (JP) ..... 2003-096044

(51) Int. Cl.
*G03G 15/20* (2006.01)

(52) U.S. Cl. ..... 399/68; 399/399; 399/67; 399/69

(58) Field of Classification Search ..... 399/67, 399/68, 69

See application file for complete search history.

(56) References Cited

U.S. PATENT DOCUMENTS 4,970,219 A 11/1990 Effland et al. ..... 514/339
5,210,579 A 5/1993 Setoriyama et al. ..... 355/285

(Continued)

FOREIGN PATENT DOCUMENTS

JP 63-313182 12/1988

(Continued)

*Primary Examiner*—David M. Gray
*Assistant Examiner*—Ryan D. Walsh
(74) *Attorney, Agent, or Firm*—Fitzpatrick, Cella, Harper & Scinto

(57) ABSTRACT

An image generating apparatus is provided which can maximize the throughput without causing thermal damage of the fusing components. It determines a sub-thermistor temperature threshold value for switching small size paper feed intervals in response to a sub-thermistor initial temperature. It supplies a heating body with current for heating, and starts feeding recording mediums at the feed interval determined by a feed interval initial value. It makes a successively conveyed paper count. Every time the successively conveyed paper count reaches a paper count threshold value, it performs the switching control of the sub-thermistor temperature threshold value. If the sub-thermistor temperature exceeds the threshold value while the recording medium is passing through the fusing apparatus, it carries out the switching control of the feed intervals. In another mode, it prevents the extension of the paper feed interval of the paper conveyance during a specified paper count α.

3 Claims, 24 Drawing Sheets

U.S. PATENT DOCUMENTS

| | | | | |
|---|---|---|---|---|
| 5,444,521 | A | 8/1995 | Tomoyuki et al. | 355/285 |
| 5,525,775 | A | 6/1996 | Setoriyama et al. | 219/216 |
| 5,534,987 | A | 7/1996 | Ohtsuka et al. | 355/285 |
| 5,552,874 | A | 9/1996 | Ohtsuka et al. | 355/285 |
| 5,592,276 | A | 1/1997 | Ohtsuka et al. | 339/335 |
| 5,621,510 | A | 4/1997 | Okuda et al. | 399/338 |
| 5,801,360 | A | 9/1998 | Oba et al. | 219/216 |
| 5,852,763 | A | 12/1998 | Okuda et al. | 399/329 |
| 6,094,559 | A | 7/2000 | Otsuka et al. | 399/327 |
| 6,151,462 | A | 11/2000 | Fukuzawa et al. | 399/67 |
| 6,175,699 | B1 | 1/2001 | Kato et al. | 399/69 |
| 6,377,777 | B1 | 4/2002 | Kishino et al. | 399/329 |
| 6,466,751 | B1 | 10/2002 | Kawano | 399/68 |
| 6,583,389 | B2 | 6/2003 | Murooka et al. | 219/216 |
| 2002/0094212 | A1 | 7/2002 | Suzumi | 399/69 |
| 2002/0141772 | A1 | 10/2002 | Kawano | 399/68 |
| 2005/0019050 | A1 | 1/2005 | Umezawa | 399/69 |

FOREIGN PATENT DOCUMENTS

| | | |
|---|---|---|
| JP | 02-157878 | 6/1990 |
| JP | 4-44075 | 2/1992 |
| JP | 4-204980 | 7/1992 |
| JP | 5-80604 | 4/1993 |
| JP | 5-80605 | 4/1993 |
| JP | 5-80665 | 4/1993 |
| JP | 2002-162862 | 6/2002 |
| JP | 2002-169413 | 6/2002 |

AT COLD START(TaO=25℃)

AT HOT START(TaO=100℃)

—— SUB-THERMISTOR DETECTION TEMPERATURE Ta

····· PRESS ROLLER SURFACE TEMPERATURE Tb

——— SUB-THERMISTOR DETECTION TEMPERATURE Ta

····· PRESS ROLLER SURFACE TEMPERATURE Tb

EFFECT 1 OF EMBODIMENT

——— : PAPER FEED INTERVAL SWITCHING CONTROL OF EMBODIMENT 3
- - - - : CONVENTIONAL TEMPERATURE SWITCHING CONTROL

EFFECT 2 OF EMBODIMENT

——— : PAPER FEED INTERVAL SWITCHING CONTROL OF EMBODIMENT 7

- - - - : CONVENTIONAL TEMPERATURE DETECTION SWITCHING CONTROL

↑ : TIMING AT WHICH RECORDING MEDIUM IS SWITCHED FROM COM10 ENVELOPE TO EXE SIZE THIN PAPER DURING SUCCESSIVE PAPER CONVEYANCE

IMAGE FORMING APPARATUS

This application claims priority from Japanese Patent Application NMOS. 2003-096044 filed Mar. 31, 2003 and 2003-095219 filed Mar. 31, 2003, which are incorporated hereinto by reference.

BACKGROUND OF THE INVENTION

1. Field of the Invention

The present invention relates to an image generating apparatus such as printers, copying machines and fax machines, and more particularly, to an improvement of an image generating apparatus with a thermal fusing apparatus using a thermal roller system or film heat system as an apparatus for fusing an unfused image formed and borne on a recording medium.

2. Description of the Related Art

As a fusing apparatus (sometimes called "fusser") for the image generating apparatus such as a copying machine and a printer, a thermal roller system or film heat system has been known conventionally.

In particular, the thermal fusing apparatus based on the film heat system has an advantage of being able to suppress the power consumption to an extremely low level because it does not require power supply during standby, thereby offering an effective energy-saving, on-demand fusing apparatus. The thermal fusing apparatus based on the film heat system is disclosed in Japanese Patent Application Laid-open Nos. 63-313182(1988), 2-157878(1990), 4-044075 (1992), and 4-204980(1992).

The thermal fusing apparatus based on the film heat system basically includes a heater (heating component, heating body) fixed to a supporting body; a fusing component including a heat resistant thin film (fusing film) sliding on the heater; and a press roller as a pressing component for forming a fusing nip by press-contacting the heater via the film. The fusing nip pinches and transports the recording medium on which the unfused image is formed so that the unfused image is thermally fused as a permanent image by the heat fed from the heater via the film.

The fusing apparatus based on the film heat system can reduce the heat capacity of the heating body itself and of the film placed between the heating body and recording medium as compared with the other well-known fusing apparatuses such as a thermal roller system. Accordingly, it is superior to them in terms of power saving and quick start (reduction in wait time).

As the heater, a ceramic heater is generally used. For example, ceramic substrates of alumina ($Al_2O_3$), aluminum nitride (AlN) and the like are used as the heater substrate, because they have such properties as high electric insulation, good heat conduction and low heat capacity. On the heater substrate, a heating resistance layer composed of silver palladium (Ag/Pd), $Ta_2N$ or the like is formed by screen printing, followed by coating the surface of the heating resistance layer with a thin glass protective layer. As for the ceramic heater, its heating resistance layer is heated by the current flowing through it so that the heater increases its temperature sharply in its entirety including the ceramic substrate and glass protective layer. The temperature rise of the heater is detected by a thermistor, a temperature detecting means, which is disposed at the back of the heater, and is fed back to a current controller. The current controller controls the current to be supplied to the heating resistance layer such that the heater temperature detected by the thermistor is maintained at approximately a specified temperature (fusing temperature). Thus, the heater is heated and controlled at the specified fusing temperature.

The thermistor disposed at the back of the heater is usually an ETC thermistor or the like. An example of a heat resistant, high insulating structure is shown in FIG. 1. It has a thermistor unit that includes a heat resistant, heat-insulating, elastic ceramic fiber layer 76*b*, the so-called "ceramic paper layer", a polyimide thin film 76*d*, and an ETC thermistor 76*c* disposed between them. The thermistor unit is pressed to the back of the heater with appropriate pressure. Alternatively, a structure (not shown) is known which has a conductive pattern formed on the back of the heater, and a thermistor conductively adhered thereto via a heat conduction adhesive.

As for the image generating apparatus including the fusing apparatus, configurations are known which have a plurality of thermistors mounted on the heater in the fusing apparatus to control power of the heater using them as disclosed in Japanese Patent Application Laid-open Nos. 5-080604(1993), 5-080605(1993), and 5-080665(1993).

In such an image generating apparatus, when a paper conveyance reference occupies the center of the fusing apparatus, for example, a first thermistor (main thermistor) is placed at the center in the longitudinal direction of the back of the heater (direction perpendicular to the conveyance direction), and second thermistor (sub-thermistor) is placed at a longitudinal end of the heating body. The power control is carried out for maintaining the heater temperature at the target temperature in response to the temperature detected by the main thermistor.

SUMMARY OF THE INVENTION

The present invention is implemented to solve the foregoing problems relating to the thermal resistance in an image generating apparatus having a fusing apparatus including a plurality of thermistors. Therefore an object of the present invention is to provide an image generating apparatus capable of increasing the throughput of small size papers without causing thermal damage of the fusing components.

According to a first aspect of the present invention, there is provided an image generating apparatus for forming an image on a recording medium, the image generating apparatus comprising: an image generating section for forming a toner image on a recording medium; a fusing section including a heating component for heating the recording medium to fuse the toner image onto the recording medium, and a pressing component for pressing and rotating the recording medium in conjunction with the heating component; an edge temperature detecting section for detecting temperature of the heating component at an edge of a conveyance region of the recording medium in the heating component; and a control section for controlling feeding recording mediums in response to compared results of the temperature detected by the edge temperature detecting section with a specified threshold temperature, wherein said control section sets the specified threshold temperature based on the temperature detected by said edge temperature detecting section.

The image generating apparatus can further comprise: a center temperature detecting section for detecting temperature of the heating component near a center of the conveyance region of the recording mediums in the heating component; and a fusing temperature control section for controlling heating by the heating component such that the temperature detected by the center temperature detecting section matches a specified fusing temperature.

The control section can determine, before forming the toner image successively on a plurality of recording mediums, the specified threshold temperature in response to the temperature detected by said center temperature detecting section or the edge temperature detecting section.

The control section can set a first threshold temperature when the temperature detected by the edge temperature detecting section is a first temperature, and set a second threshold temperature higher than the first threshold temperature when the temperature detected by the edge temperature detecting section is a second temperature lower than the first temperature.

The heating component can comprise a cylindrical film rotating slidingly on the pressing component, and a heater component for heating the recording medium via the cylindrical film, wherein the edge temperature detecting section can detect the temperature of the heater component.

According to a second aspect of the present invention, there is provided an image generating apparatus for forming an image on a recording medium, the image generating apparatus comprising: an image generating section for forming a toner image on a recording medium; a fusing section including a heating component for heating the recording medium to fuse the toner image onto the recording medium, and a pressing component for pressing and rotating the recording medium in conjunction with the heating component; a temperature detecting section for detecting temperature of the heating component; and a control section for controlling feed intervals of a plurality of recording mediums, on which the toner image is fused in the fusing section, such that the feed intervals are extended in response to a fact that the temperature detected by the temperature detecting section exceeds a specified threshold temperature, wherein the control section sets the specified threshold temperature in response to the temperature detected by the temperature detecting section when the heating component is switched from a heating state to a non-heating state.

The control section can set the specified threshold temperature in response to a difference between a first temperature detected by the temperature detecting section in the heating state of the heating component and a second temperature detected by the temperature detecting section after a specified time has elapsed after switching the heating component to the non-heating state after detecting the first temperature.

The temperature detecting section can detect the temperature of the heating component near an edge of a paper conveyance region of the recording mediums in the heating component.

The image generating apparatus can further comprise: a center temperature detecting section for detecting temperature of the heating component near a center of the conveyance region of the recording mediums in the heating component; and a fusing temperature control section for controlling heating by the heating component such that the temperature detected by the center temperature detecting section matches a specified fusing temperature.

The control section can determine, before forming the toner image successively on a plurality of recording mediums, the specified threshold temperature in response to the temperature detected by the temperature detecting section.

The control section can set a first threshold temperature when the temperature detected by the temperature detecting section is a first temperature, and set a second threshold temperature higher than the first threshold temperature when the temperature detected by the temperature detecting section is a second temperature lower than the first temperature.

The heating component can comprise a cylindrical film rotating slidingly on the pressing component, and a heater component for heating the recording medium via the cylindrical film, wherein the temperature detecting section can detect the temperature of the heater component.

According to a third aspect of the present invention, there is provided an image generating apparatus for forming an image on a recording medium, the image generating apparatus comprising: an image generating section for forming a toner image on a recording medium; a fusing section including a heating component for heating the recording medium to fuse the toner image onto the recording medium, and a pressing component for pressing and rotating the recording medium in conjunction with the heating component; an edge temperature detecting section for detecting temperature of the heating component at an edge of a conveyance region of the recording medium in the heating component; and a control section for controlling feeding recording mediums in response to compared results of the temperature detected by the edge temperature detecting section with a specified threshold temperature, wherein the control section can change the feed intervals of the recording mediums and sets a specified paper count in response to a fact that the temperature detected by the edge temperature detecting section exceeds the specified threshold temperature, in which the feed intervals are not changed when the number of fed recording mediums is lower than the specified paper count.

The control section can extend the feed intervals of the recording mediums and sets a first specified paper count in response to a fact that the temperature detected by said edge temperature detecting section exceeds the specified threshold temperature.

The first specified paper count can be a number of conveyed papers counted from a recording medium next to a recording medium at which the temperature detected by the edge temperature detecting section exceeds the specified threshold temperature.

The threshold temperature can be normally set at a first threshold temperature, and can be set at a second threshold temperature higher than the first threshold temperature during feeding recording mediums associated with the first specified paper count, and the control section can extend the feed intervals of the recording mediums in response to a fact that the temperature detected by the edge temperature detecting section exceeds the second threshold temperature.

The control section can reduce the feed intervals of the recording mediums and set a second specified paper count in response to a fact that the temperature detected by the edge temperature detecting section is lower than the specified threshold temperature.

The second specified paper count can be a number of conveyed papers counted from a recording medium next to a recording medium at which the temperature detected by the edge temperature detecting section falls below the specified threshold temperature.

The threshold temperature can be normally set at a first threshold temperature, and can be set at a second threshold temperature lower than the first threshold temperature during feeding recording mediums associated with the second specified paper count, and the control section can reduce the feed intervals of the recording mediums in response to a fact that the temperature detected by the edge temperature detecting section is lower than the second specified threshold temperature.

Thus, it can set the sub-thermistor temperature threshold value for switching control of the feed intervals during the small size paper conveyance, with considering the thermal conductivity, heat capacity and thermal resistances in the actually arranged conditions of the fusing apparatus components.

More specifically, it can set the optimum temperature threshold value considering the thermal resistances around the temperature detecting means during the paper conveyance both at a cold start and a hot start. Therefore it can maximize the throughput of the small size papers with leaving a fixed margin for the heat resistant temperature of the press roller.

In addition, it optimizes the paper feed interval switching in a throughput stage, in which the paper spacing is narrow, in a small size sequence (the so-called temperature switching control) for extending the paper feed intervals, when the detection temperature at the edge temperature detecting section in the non-paper conveyance region exceeds the threshold temperature.

Thus, it can optimize the paper feed interval switching in the throughput stage with the narrow paper spacing in the small size sequence (the so-called temperature switching control) for extending the paper feed intervals, when the detection temperature at the edge temperature detecting section in the non-paper conveyance region exceeds the threshold temperature. As a result, it can overcome the conventional problem, thereby being able to increase the throughput of the small size paper.

The above and other objects, effects and features of the present invention will become more apparent from the following description of the embodiments thereof take in conjunction with the accompanying drawings.

DETAILED DESCRIPTION OF PREFERRED EMBODIMENTS

The preferred embodiments in accordance with the invention will now be described with reference to the accompanying drawings.

Embodiment 1

The thermistor is originally used to estimate the fusing component temperature around its installation position. Accordingly, even if the thermistor detection temperature is the same, the temperatures of the individual fusing components around the thermistor installation position can differ depending on the heating conditions of the fusing apparatus.

More specifically, consider the case where the printing has a cold start, in which the fusing apparatus has no residual heat and the printing is started from nearly the room temperature, and a hot start, in which the fusing components are subjected to long heating and the printing is started from nearly the thermal equilibrium condition. In the two conditions, the fusing components, particularly the press roller, differ in the sub-thermistor detection temperatures during the small size paper conveyance.

Figure 2A:
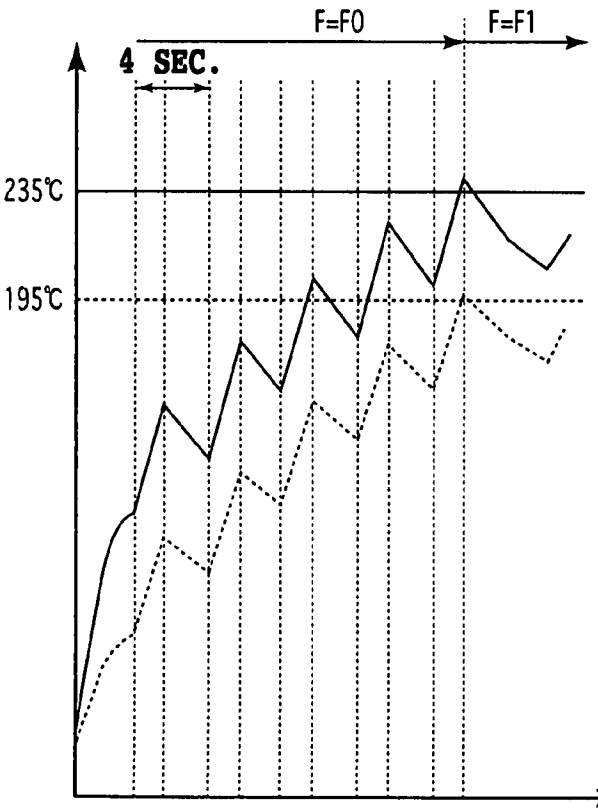
FIGS. 2A and 2B are diagrams illustrating sub-thermistor detection temperature transition and press roller surface temperature transition during paper conveyance of conventional com10 envelopes.
Figure 2B:
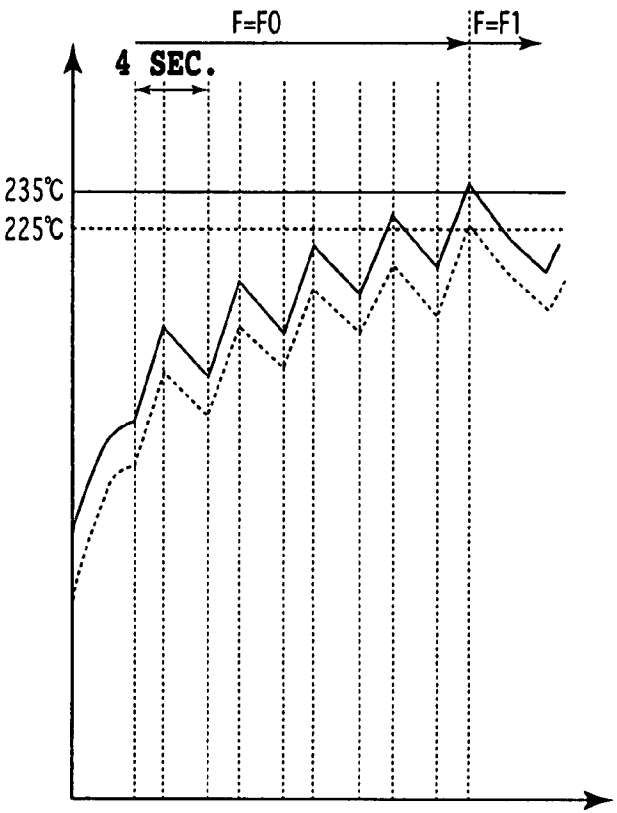

FIGS. 2A and 2B illustrate the sub-thermistor detection temperature transition and the press roller temperature transition during the successive paper conveyance of com10#582 envelopes (105 mm wide×241 mm long) as a sample of small size paper in the image generating apparatus. The press roller temperature transition is obtained by making noncontact temperature measurement of the press roller surface at the location corresponding to the installation position of the sub-thermistor in the longitudinal direction. FIG. 2A illustrates the temperature changes at the cold start (thermistor initial temperature Ta0=25° C.), and FIG. 2B illustrates those at the hot start (Ta0=100° C.).

The paper conveyance conditions in the conventional image generating apparatus are as follows: conveyance speed Vp is Vp=150 mm/sec; the feed interval F at the start of the small size paper conveyance is F=F0 (=4 seconds [15 ppm]); and the sub-thermistor temperature threshold value Tth for the feed interval switching control during the successive paper conveyance is Tth=235° C. In addition, as for the control settings, every time the temperature of the sub-thermistor exceeds Tth during the successive paper conveyance, the next feed interval F is sequentially switched from F0=4 seconds (15 ppm) to F1=6 seconds (10 ppm), to F2=7.5 seconds (8 ppm), and to F3=10 seconds (6 ppm). FIGS. 2A and 2B illustrate the temperature transition up to the point at which the sub-thermistor detection temperature reaches Tth for the first time from the print start.

As seen from FIGS. 2A and 2B, when the sub-thermistor detection temperature reaches Tth, the press roller temperature Tb rises to Tb=approximately 195° C. at the cold start, and to Tb=approximately 225° C. at the hot start. The temperature difference relates to the thermal resistances of the components of the fusing apparatus. Specifically, the temperature difference results from the difference at the cold start and hot start in the balance between the thermal resistance from the heating element of the heater to the sub-thermistor via the heater substrate and polyimide layer, and the thermal resistance from the heating element to the press roller via the glass protective layer and film.

As for the heat-resistant properties of the individual components around the fusing nip, the melting, damage and the like occur because of overheating at the following temperatures: at 230° C. for the press roller composed of the silicone rubber layer and PFA top layer; at 300° C. for the fusing film composed of a polyimide base layer and a fluoroplastic coat layer; at 400° C. for the heater composed of the ceramic substrate and the like; and at 300° C. for the heater supporting component composed of a liquid crystal polymer (LCP). Thus, it is essential for the press roller with the least heat resistant margin among the foregoing fusing components to maintain its surface temperature at 230° C. or less.

In the ordinary fusing control, particularly in the control switching in response to the sub-thermistor temperature detection during the small size paper conveyance such as envelopes, the thermal resistances of the individual components of the fusing apparatus are not considered. Thus, it has only one thermistor temperature threshold value for the control switching normally. Consequently, to ensure the heat resistant temperature margin of the press roller, the throughput of the small size paper cannot be maximized.

More specifically, the foregoing example determines the temperature threshold value at a value that will meet the heat resistant temperatures of the individual components in the warmup conditions of the fusing apparatus. Accordingly, the throughput is reduced when using the temperature threshold value at the cold start in which the press roller heat resistant temperature has a considerable margin.

The phenomenon becomes apparent as the difference increases between the thermal resistance from the heating element of the heater to the thermistor and the thermal resistance from the heating element to the press roller.

Figure 3:
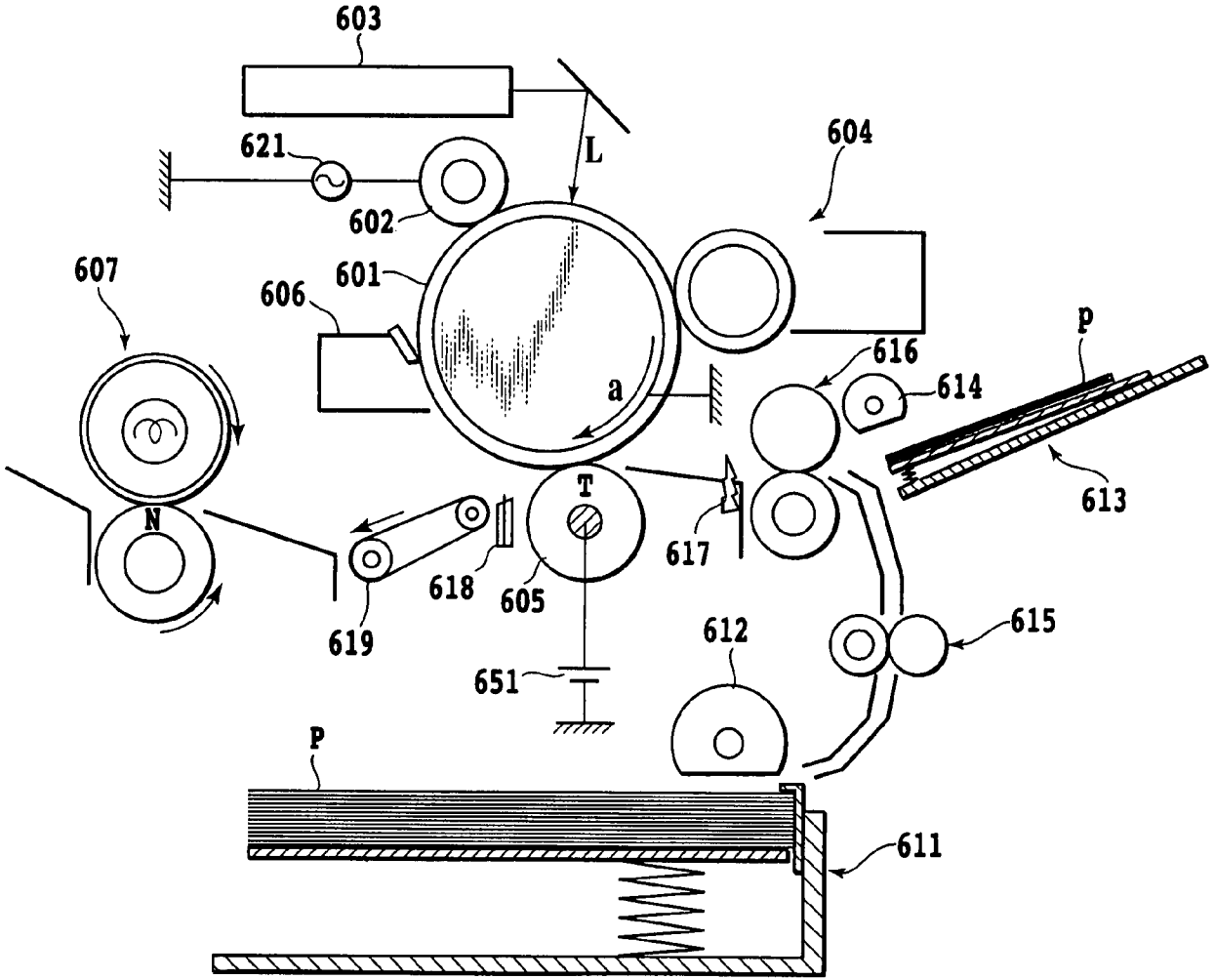
FIG. 3 is a schematic cross-sectional view showing a structure of the embodiment of the image generating apparatus in accordance with the present invention.

FIG. 3 shows the present embodiment of the image generating apparatus. The example of the image generating apparatus is a copying machine or a laser printer utilizing a transfer electrophotographic process. The image generating apparatus includes a photoconductive drum 601 that rotates in the direction of an arrow a. Around the photoconductive drum 601, are disposed a charging roller 602, an exposure unit 603, a development unit 604, a transfer roller 605, and a cleaning unit 606. In addition, from the upstream side of the conveyance direction of the recording mediums P on which an image is formed, are disposed a first paper feed cassette 611, a first paper feed roller 612, an intermediate transport roller pair 615, a resist roller pair 616, a recording medium sensor 617, and a fusing apparatus 607 in this order. As for the width of the recording mediums P in the longitudinal direction (direction perpendicular to the conveyance direction), since the maximum paper conveyance width of the present embodiment of the image generating apparatus is 216 mm, a recording medium P with a rather narrow width such as an envelope or postcard (called "small size recording medium" from now on) compared with the maximum paper conveyance width is transported from a second paper feed cassette 613 to the resist roller pair 616 by the second paper feed roller 614.

Next, the image generating operation of the foregoing image generating apparatus will be described.

The photoconductive drum 601 is a rotation drum type electrophotographic photosensitive body serving as an image carrier.

The charging roller 602 uniformly charges the outer periphery surface of the rotating photoconductive drum 601 to a specified polarity and potential.

The exposure unit 603, which consists of a slit exposure mechanism of a manuscript image or a laser scanner, exposes an image on the uniformly charged processing surface of the rotating photoconductive drum 601.

The development unit 604 develops the electrostatic latent image on the surface of the photoconductive drum as a toner image.

The transfer roller 605 makes contact with the photoconductive drum 601 at a specified pressure, thereby forming the transfer nip T.

The cleaning unit 606 removes the residual toner from the surface of the photoconductive drum after the recording medium is separated. The cleaned-up photoconductive drum from which the residual toner is removed is used for the image formation repeatedly.

The paper feed cassette 611 is inserted into a paper feed mechanism and contains a pile of the recording mediums P. The recording mediums P in the paper feed cassette 611 are separated one by one by the paper feed roller 612 rotationally driven in response to a paper feed start signal, and are fed to the transfer nip T at the specified control timing in synchronism with the process of image formation on the photoconductive drum by the resist roller pair 616.

During the image formation, the photoconductive drum 601 is rotationally driven in the direction of the arrow a by a driving means (not shown) at a specified control peripheral velocity, and is charged to a specified potential, −600 V, for example, by the charging roller 602. Then, the photoconductive drum 601 is irradiated with a laser beam L that is sent out from the exposure unit 603 and corresponds to the image signal so that the potential of the portions irradiated with the laser beam L on the photoconductive drum 601 is reduced to a specified value, −150 V, for example. Thus, an electrostatic latent image is generated. Subsequently, the development unit 604 inversely develops negatively charged toner on the portions of the electrostatic latent image irradiated with the laser beam L, thereby generating a toner image.

Then, a recording medium conveyed by the second paper feed roller 614 from the second paper feed cassette 613 to the resist roller pair 616 (or the recording mediums P pulled out of the first paper feed cassette 611 one by one by the paper feed roller 612 to be conveyed by the intermediate transport roller pair 615 to the resist roller pair 616), passes through the recording medium sensor 617, and is fed to the transfer nip between the photoconductive drum 601 and the transfer roller 605. In this case, the recording medium sensor 617 detects the passage of the front edge and rear edge of the recording medium for adjusting the timings of the individual control.

The transfer roller 605 is supplied with a specified positive transfer bias by a transfer bias control means 651 so that the toner image is transferred from the photoconductive drum 601 to the recording medium P. The recording medium P to which the toner image is transferred is separated using the curvature of the photoconductive drum 601, and its surplus charges are removed through an antistatic needle 618 placed immediately after the transfer section. The recording medium P separated from the photoconductive drum 601 is conveyed to the fusing apparatus 607 to be subjected to the heating and pressure in the fusing nip N so that the transferred toner image is fused as a permanent fixed image on the recording medium, and is output.

Figure 4:
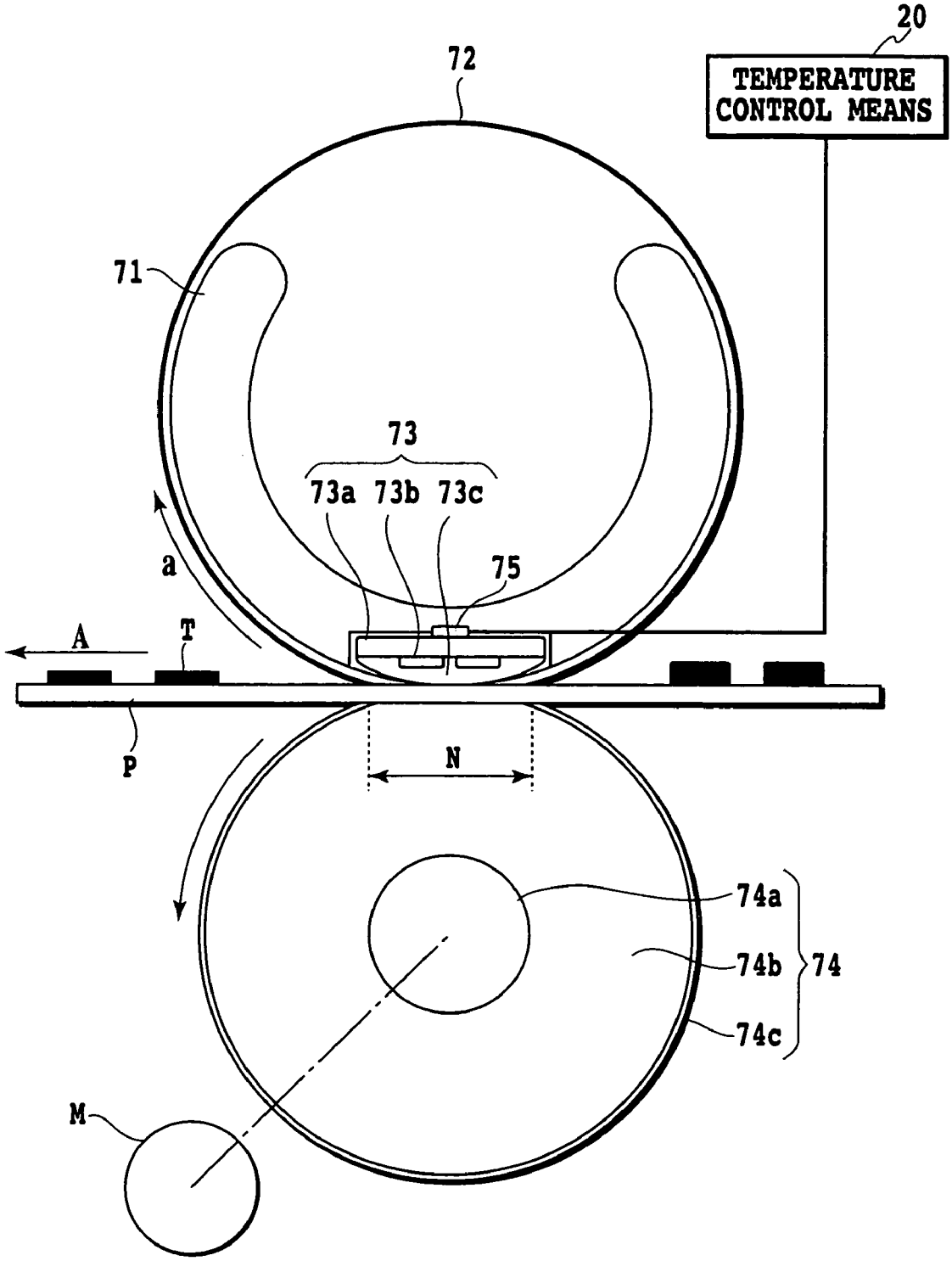
FIG. 4 is a schematic cross-sectional view showing a structure of a fusing apparatus based on the film heat system in accordance with the present invention.

FIG. 4 is a schematic cross-sectional view showing a structure of a film heat type fusing apparatus installed in the image generating apparatus in accordance with the present invention. The fusing apparatus of the present embodiment is a press roller driving type. It has a film guide 71 that holds a heater 73 pressed onto a press roller 74 via a cylindrical heat resistant film (fusing film) 72 with a specified pressure, thereby forming a fusing nip N between the press roller 74 and the heater 73.

When the press roller 74 is rotationally driven, frictional force between the press roller 74 and the outer surface of the heat resistant film 72 causes rotation force to be applied to the heat resistant film 72, thereby rotating the heat resistant film 72 around the film guide 71 holding the heater 73 in the direction of the arrow a.

The cylindrical heat resistant film 72 is a thin film cylinder using, for example, a 10 μm-100 μm thick polyimide as a base layer, which is coated with PFA or PTFE via a conductive primer to provide the film with release characteristics from the toner.

Figure 5:
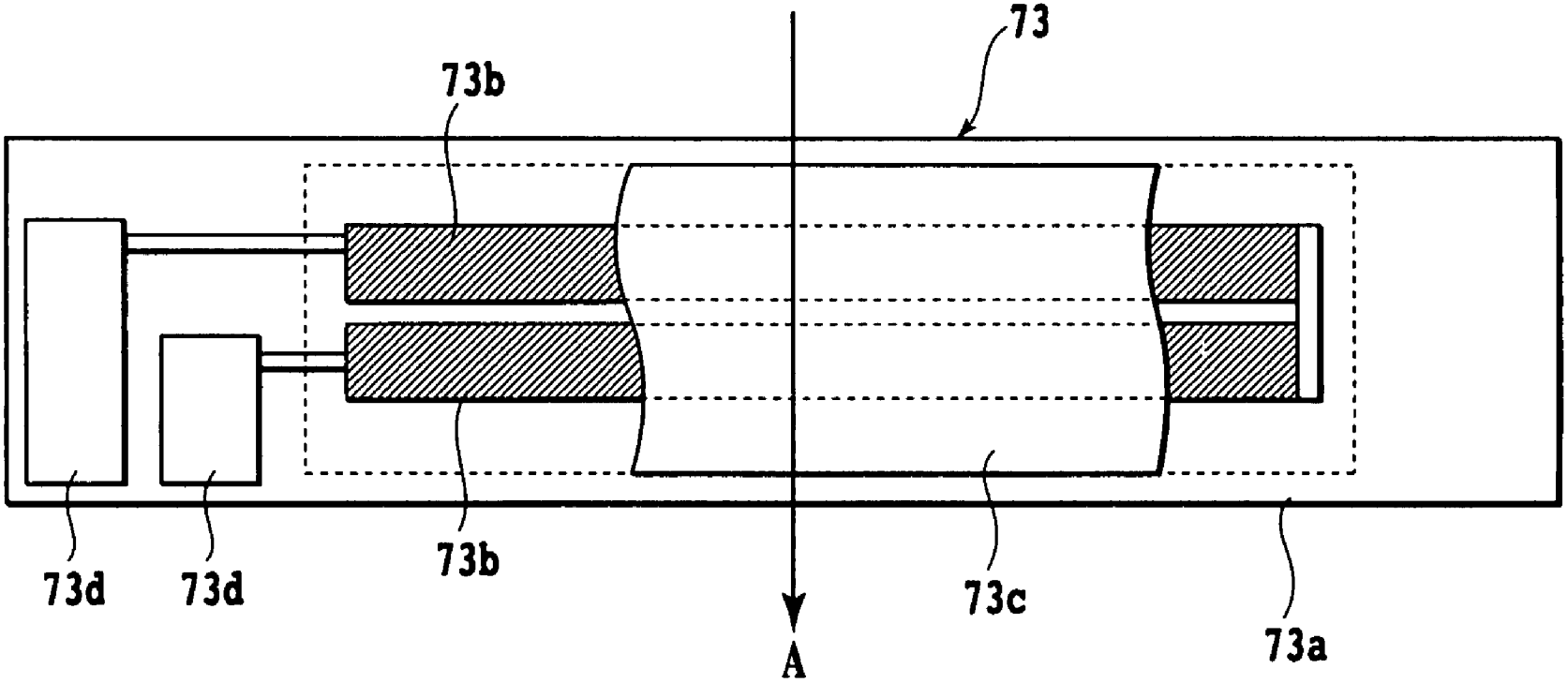
FIG. 5 is a partially cutaway view of a heating body surface (heating element side) in the embodiment of the fusing apparatus in accordance with the present invention.

FIG. 5 shows a structure of the heater 73. It includes a heater substrate 73*a*, a resistance heating element pattern 73*b* formed on one side of the heater substrate 73*a*, a surface protective layer 73*c* for covering the resistance heating element pattern 73*b*, and a feeding electrode pattern 73*d*.

The heater substrate 73*a* has a longitudinal direction perpendicular to the conveyance direction A of the recording paper P as a heated component, and thus it is wide from side to side and thin. For example, it is composed of a 270 mm wide, 8 mm long and 1 mm thick heat resistant, electrically insulating, low heat capacity ceramic base such as alumina.

Figure 6:
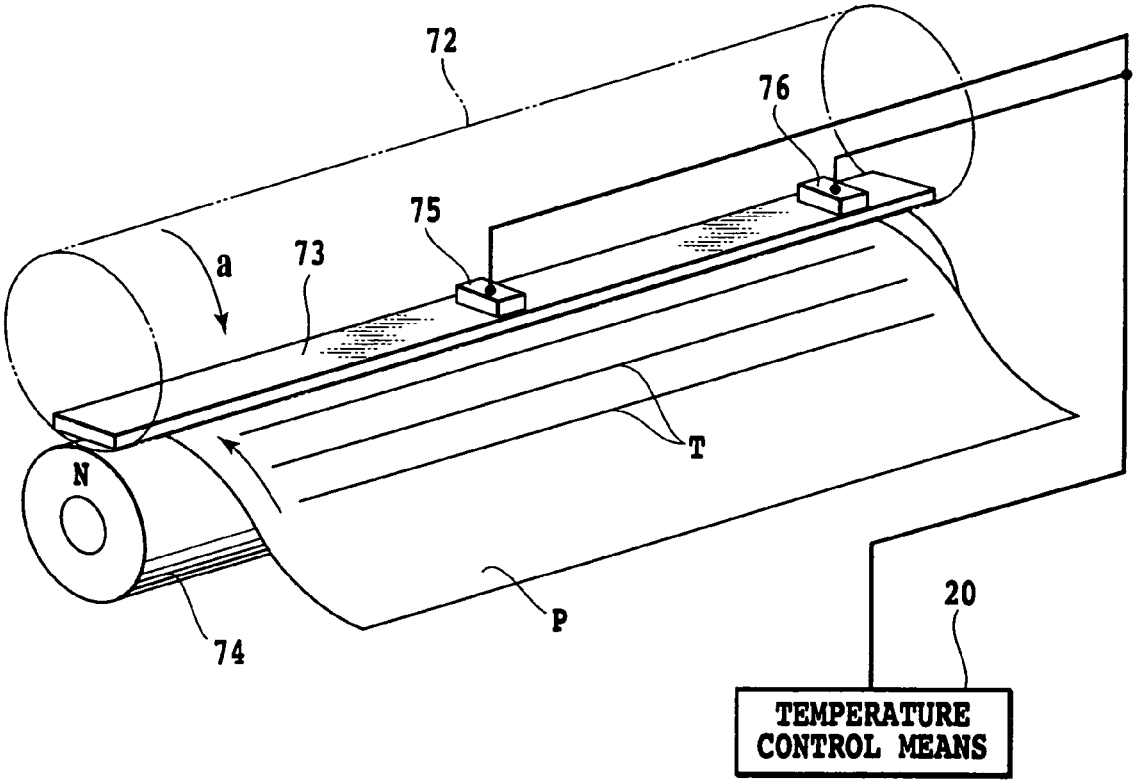
FIG. 6 is a schematic perspective view showing surroundings of thermistors in the embodiment of the fusing apparatus in accordance with the present invention.

The current supply to the heater 73 is controlled by the temperature control means 20. As shown in FIG. 6, the temperature control means 20 is divided into two circuits that include a first temperature detector 75 (called "main thermistor" from now on) and a second temperature detector 76 (called "sub-thermistor" from now on), respectively. Assume that the surface on which the resistance heating element pattern 73*b* of the heater 73 is formed is the first surface of the heating body. Then the main thermistor 75 is mounted on the second surface of the heater 73 at the location corresponding to the center of the recording paper P, and the sub-thermistor 76 is mounted on the second surface at the location corresponding to an end of the heating region. The sub-thermistor 76 is installed inside the maximum paper conveyance width, and outside the minimum paper conveyance width.

The temperature control means 20 includes a CPU for controlling the current supply to the heater 73 (control of the heating value of the heating body) in response to the temperature detected by the main thermistor 75.

As for the power control to the heater 73 by the CPU, it is possible to use zero-cross wave number control that enables and stops the current supply at every half wave interval of the power supply waveform, or a multi-stage power control method such as phase control that controls the phase angle of the current supply at every half wave interval of the power supply waveform.

The rotation of the press roller 74 causes the rotation of the heat resistant film 72, and the temperature control means 20 controls the current supply to the heater 73. Then when the heater 73 reaches the specified temperature, the recording paper P carrying the unfused toner image T is introduced to the fusing nip N between the heat resistant film 72 and the press roller 74. Thus, the heat of the heating body 73 is supplied to the recording paper P via the heat resistant film 72 so that the unfused toner image T is fused onto the surface of the recording paper P. The recording paper P passing through the fusing nip N is separated from the surface of the heat resistant film 72 using its curvature, and is output.

In this way, the fusing apparatus has the fusing nip, which is formed by press-contacting the pressing component onto the heating body, pinch and transport the recording medium having the unfused image so that the unfused image is fused onto the recording medium by heating and pressure. More specifically, the fusing apparatus is configured such that it comprises the fusing component including the thin film sliding on the heating body, and the pressing component for forming the fusing nip by press-contacting the heating body via the thin film; and that the fusing nip pinches and transports the recording medium on which the unfused image is formed, and the heat supplied from the heating body via the thin film fuses the unfused image on the recording medium as the permanent image.

Figure 1:
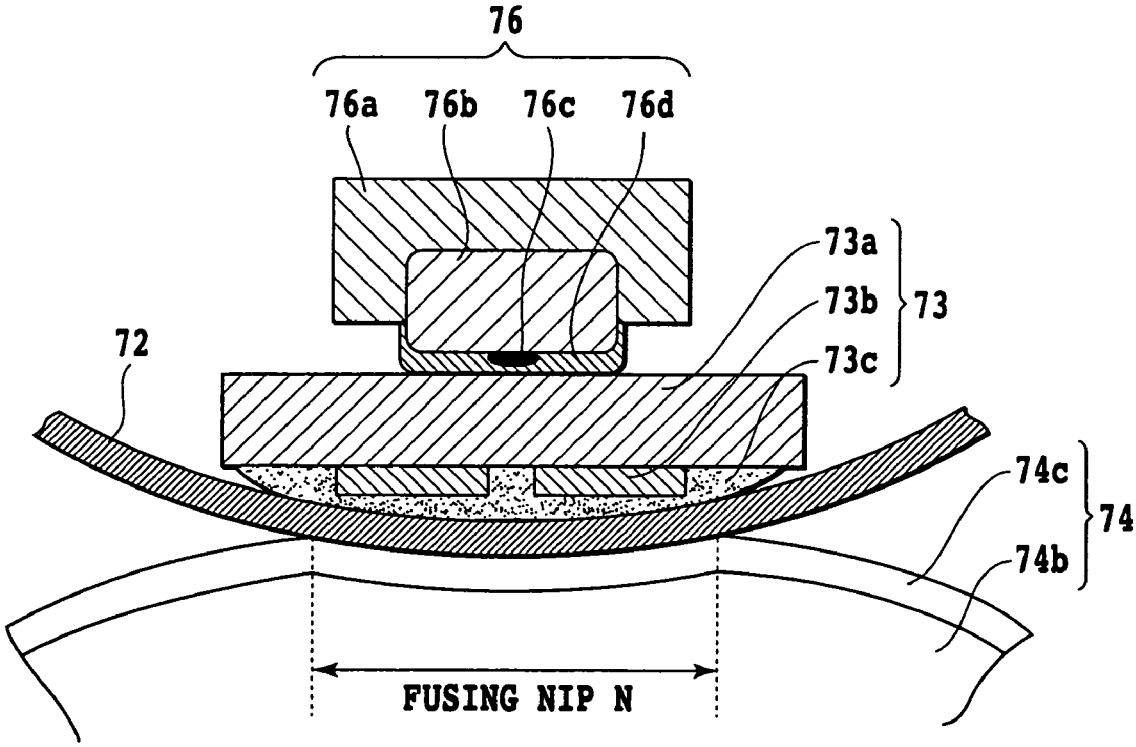
FIG. 1 is a schematic cross-sectional view showing a structure near a fusing nip of an embodiment in accordance with the present invention.

As for the structure around the sub-thermistor 76 of the present embodiment, the configuration as shown in FIG. 1 is applicable. The sub-thermistor 76 comprises as its integral parts a thermistor holder 76*a* fixed by a fixing component (not shown), a heat resistant, heat insulating, elastic ceramic fiber layer 76*b*, an ETC thermistor 76*c*, and a polyimide thin film 76*d*. The sub-thermistor 76 detects the temperature of the heater 73 with pressing the back of the heater 73 with appropriate pressure. The main thermistor 75 has the same configuration.

The press roller 74 has a structure as shown in FIG. 4. It includes a core bar 74*a*, a silicone rubber layer 74*b* formed on the core bar 74*a* as a base layer, a primer layer (not shown) formed on the silicone rubber layer 74*b*, and a 10-100 μm thick PFA top layer 74*c* formed on the primer layer to provide release characteristics from the toner. The heat resistant temperature of the PFA top layer 74*c* is 260° C., and that of the silicone rubber layer 74*b* is 230° C. Since the PFA top layer 74*c* serves as the thermal resistance for the silicone rubber layer 74*b*, the performance of the entire press roller 74 does not deteriorate as long as the surface of the press roller 74 does not exceed 230° C. for a long time. The core bar 74*a* is rotatably mounted across the sidewalls of the fusing apparatus via the bearings supporting the ends of the core bar 74*a*. In addition, the core bar 74*a* has its one end fitted with a gear so that a driving motor M rotates the press roller 74 counterclockwise as indicated by the arrow.

Furthermore, as shown in FIG. 1, across the resistance heating element pattern 73*b* and the ETC thermistor 76*c* in the heater 73, a thermal resistance Ra is present due to the heater substrate 73*a* and polyimide thin film 76*d*. On the other hand, across the resistance heating element pattern 73*b* and the surface of the press roller 74, a thermal resistance Rb is present due to the surface protective layer 73*c* and fusing film 72, with holding the relationship Ra<Rb in the present embodiment. This means that the relationship Ta≧Tb is always satisfied for the temperature changes of the individual components by the heat control of the resistance heating element pattern 73*b*, where Ta is the sub-thermistor detection temperature and Tb is the press roller surface temperature. The temperatures Ta and Tb become closer as the conditions approach the thermal equilibrium.

The main control will now be described when a small size paper is conveyed using the present embodiment of the image generating apparatus. The present embodiment employs a small size paper feed method that monitors the temperature Ta of the sub-thermistor 76 during the successive paper conveyance, and prolongs the feed interval F of the recording mediums P from the next time when Ta exceeds the sub-thermistor temperature threshold value Tth. The present embodiment employs a feed interval F0=4 seconds (15 ppm) as the initial value, and sequentially switches the feed interval F such as from F0 to F1=6 seconds (10 ppm), to F2=7.5 seconds (8 ppm), and to F3=10 seconds (6 ppm), provided Ta≧Tth.

Figure 7:
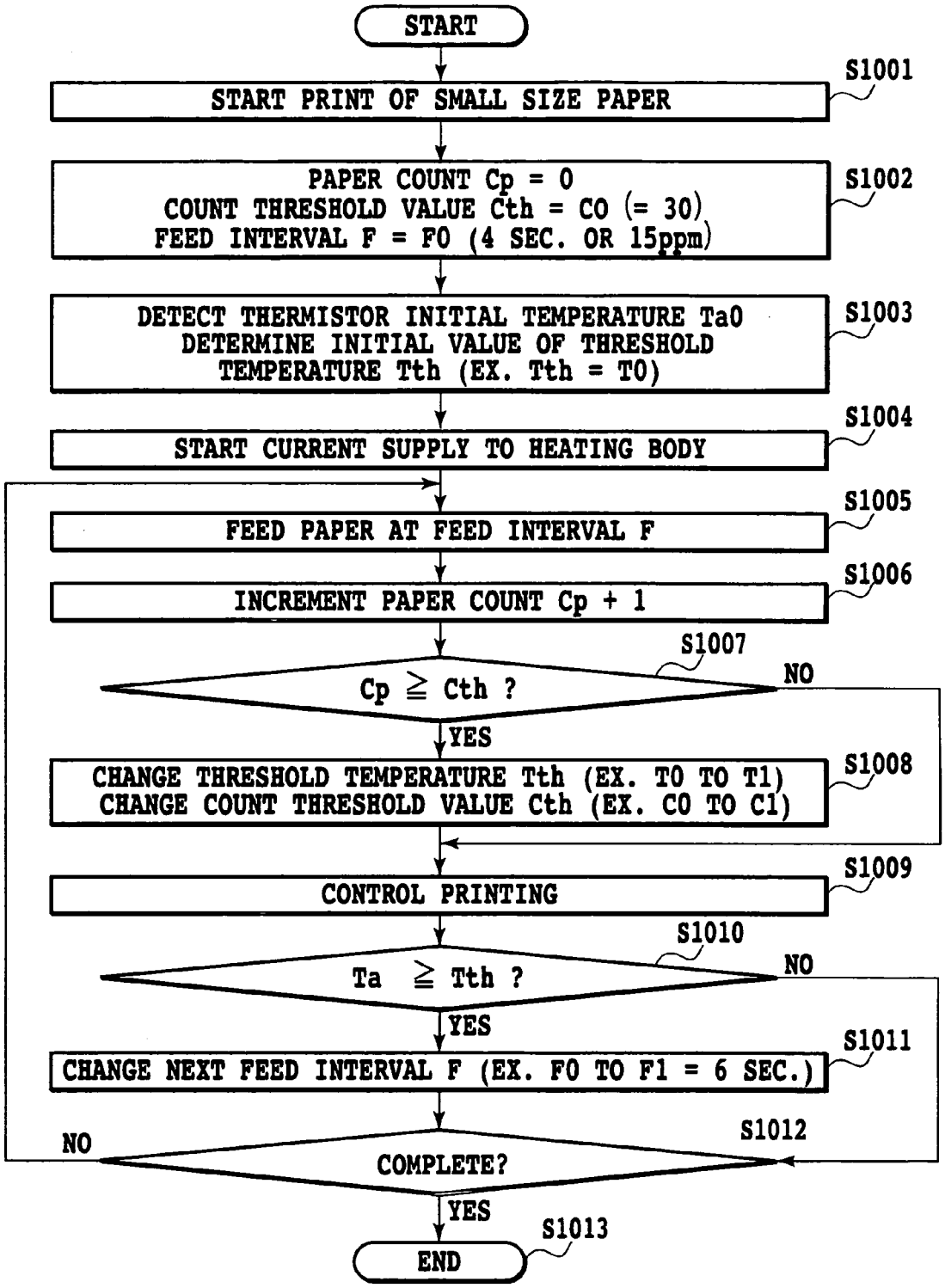
FIG. 7 is a flowchart of the control of the embodiment of the image generating apparatus in accordance with the present invention.

Next, the details of the main control performed by the temperature control means 20 will be described with reference to the flowchart of FIG. 7. First, after receiving the small size paper print signal, the CPU detects the sub-thermistor initial temperature Ta0, and determines the sub-thermistor temperature threshold value Tth for switching the small size paper feed interval in accordance with Ta0 (S1001-S1003). More specifically, considering that the state from receiving an actuation command of the image generating apparatus to just before the start of heating the fusing apparatus is a heating halt state, the CPU detects the temperature of the sub-thermistor 76 in the heating halt state, and determines the specified threshold value in accordance with the detection temperature.

In the present embodiment, one of T1=260° C., T2=250° C., T3=240° C. and T4=250° C. as shown in Table 1 is selected as Tth in response to Ta0 at the print start.

TABLE 1

Sub-thermistor Temperature Threshold Value for Sub-Thermistor Initial Temperature

| Ta0 | Tth |
|---|---|
| Ta0 ≦ 40° C. | T1 (260° C.) |
| 40° C. < Ta0 ≦ 80° C. | T2 (250° C.) |
| 80° C. < Ta0 ≦ 120° C. | T3 (240° C.) |
| 120° C. < Ta0 | T4 (235° C.) |

Subsequently, the temperature control means 20 supplies current to the heater 73 at specified timing (S1004), and starts to feed the recording mediums P at the initial feed intervals F0=4 seconds (15 ppm) (S1005).

As described above, the temperature control means 20 determines the temperature threshold value Tth in response to the initial temperature Ta0 of the sub-thermistor 76 in the present embodiment. Thus the temperature control means 20 can estimate the warmth of the individual components around the installation position of the sub-thermistor 76 from Ta0. In the present embodiment, it can estimate the temperature difference between Ta0 and the initial temperature Tb0 of the press roller 74, and the temperature rises in the individual components during the paper conveyance. As a result, the temperature control means 20 can set the optimum temperature threshold value of the sub-thermistor 76 that can prevent the press roller 74 from exceeding its heat resistant temperature of 230° C. The relationships between Ta0 and Tth in Table 1 are determined after a preliminary study so as to prevent the press roller 74 from exceeding the heat resistant temperature.

Subsequently, the temperature control means 20 makes a successively conveyed paper count Cp every time the recording mediums P pass through the recording medium sensor 617 installed before the transfer roller 605 during the successive paper conveyance of the recording mediums P (S1006). Then every time the successively conveyed paper count Cp reaches a paper count threshold value Cth, the temperature control means 20 carries out the switching control of the sub-thermistor temperature threshold value Tth from T(n) to T(n+1) (S1007 and S1008). In the present embodiment, the value of Cth is set at C0=30, C1=60, and C2=100, and Tth is switched every time the successively conveyed paper count reaches Cth. For example, when started from Tth=T1, it is switched in the sequence T1→T2→T3→T4 every time the paper count exceeds Cth. When started from Tth=T3, Tth is switched such from T3 to T4 when the paper count exceeds C0, and the state Tth=T4 is maintained in the subsequent successive paper conveyance. In this way, the number of the successively conveyed recording mediums is counted so that the specified threshold value is determined in accordance with the successively conveyed paper count of the recording mediums.

The reason for performing the sequential switching control is that the long time fusing causes the individual components of the fusing apparatus 607 to approach a high temperature side thermal equilibrium, and hence the sub-thermistor temperature threshold value Tth must be corrected according to the reduction in the temperature difference between the sub-thermistor temperature Ta and the press roller temperature Tb.

Carrying out the foregoing control during the successive paper conveyance, the temperature control means 20 switches the feed interval F from the paper feed of the next recording medium, when the sub-thermistor temperature Ta exceeds Tth while the recording medium P is passing through the fusing apparatus 607 (S1010 and S1011). In this way, the temperature control means 20 continues the processing until the completion of the printing (S1012).

Figure 8A:
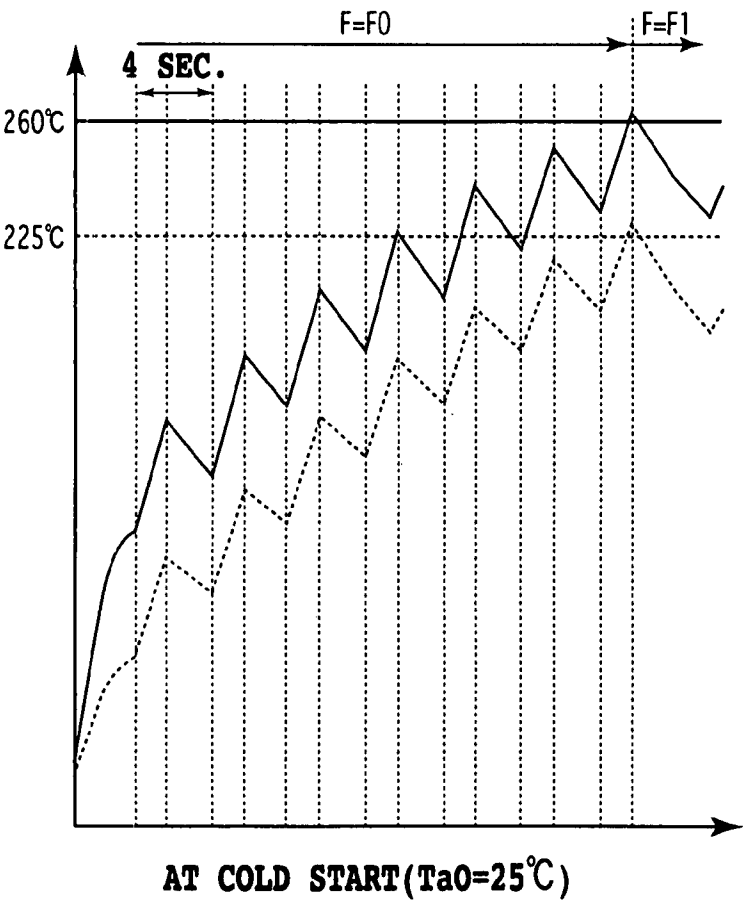
FIGS. 8A and 8B are diagrams illustrating sub-thermistor detection temperature transition and press roller surface temperature transition during paper conveyance of com10 envelopes in the embodiment in accordance with the present invention.
Figure 8B:
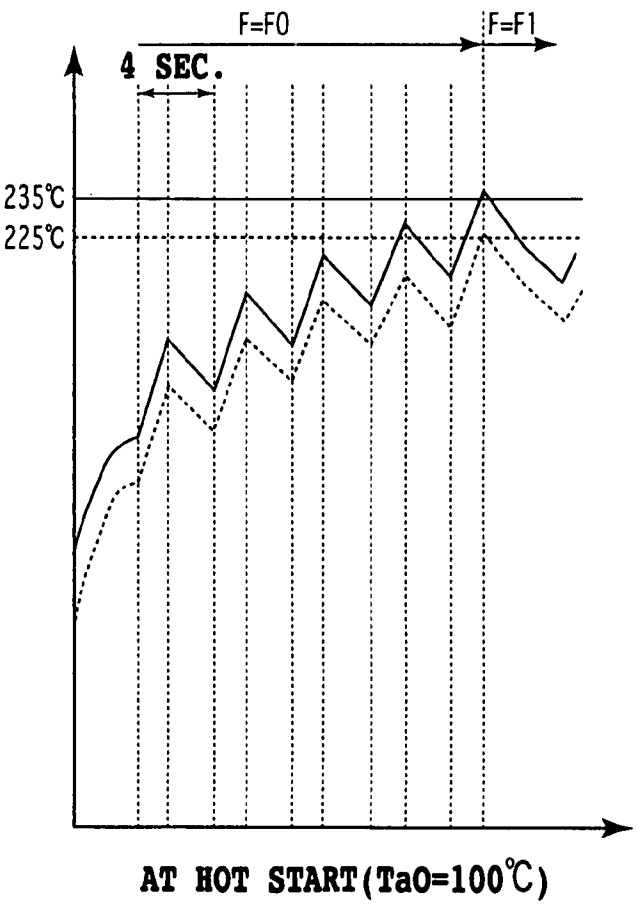

FIGS. 8A and 8B illustrate the sub-thermistor detection temperature transition and the press roller temperature transition during the successive paper conveyance of com10#582 envelopes (105 mm wide×241 mm long) in the image generating apparatus with the control function of the present embodiment. The press roller temperature transition is obtained by making noncontact temperature measurement of the press roller surface at the location corresponding to the installation position of the sub-thermistor in the longitudinal direction. FIG. 8A illustrates the measurement results at the cold start (Ta0=25° C.), and FIG. 8B illustrates those at the hot start (Ta0=100° C.), which show the temperature transitions until the sub-thermistor detection temperature reaches Tth for the first time from the print start.

As clearly seen from FIGS. 8A and 8B, the feed interval F is switched at the point where the sub-thermistor detection temperature reaches Tth at which the press roller temperature reaches Tb=approximately 225° C. in the cold start, and reaches Tb=approximately 225° C. in the hot start, as well. Thus, it is seen that the temperature threshold value of the sub-thermistor 76 is more appropriately set for the heat resistant temperature of the press roller 74 in the present embodiment than in the conventional apparatus.

As described above, the present embodiment can increase the throughput of the small size paper with maintaining the predetermined margin of the heat resistance of the individual components of the fusing apparatus 607 by setting the temperature threshold value Tth stepwise in accordance with the initial temperature of the sub-thermistor 76 at the print start, and by adjusting the temperature threshold value of the sub-thermistor 76 stepwise according to the successively conveyed paper count.

As for the detection of the initial temperature of the sub-thermistor 76, it is preferable to detect it in a condition close to the thermal equilibrium of the individual fusing components. Accordingly, it is preferable to actuate the temperature detection for a print job that is to be carried out after a predetermined time (30 seconds, for example) has elapsed from a certain print job. In this case, as for a print job occurring during the predetermined time from the end of the certain print job, it is preferable to handle them by storing the previous sub-thermistor temperature threshold value.

Although the present embodiment is described by way of example in which the thermal resistance Ra from the resistance heating element pattern 73*b* of the heater 73 to the sub-thermistor 76 is less than the thermal resistance Rb from the resistance heating element pattern 73*b* to the press roller 74, this is not essential. For example, even the opposite case can set an appropriate temperature threshold value in the same manner in accordance with the warmth of the fusing apparatus 607 considering the thermal resistances around the sub-thermistor 76, thereby being able to achieve the same effect as the present embodiment.

In addition, although the control switching in accordance with the detection temperature of the sub-thermistor 76 is carried out by switching the feed interval F in the present embodiment, any control that reduces the heating value or halts the heating of the heating body is applicable. For example, it is possible to employ the control involving the reduction in the driving velocity of the fusing apparatus such as dropping the fusing control temperature, interrupting the heating current supply between the recording mediums P, and reducing the conveyance speed of the image generating apparatus or fusing apparatus (and dropping the fusing temperature involved in the reduction); and the control of preventing the temperature rise of the fusing components such as halting the small size paper conveyance.

Although the present embodiment determines the temperature threshold value of the sub-thermistor 76 in accordance with the initial temperature of the sub-thermistor 76, this is not essential. For example, the temperature threshold value can be determined in response to the detection temperature of the main thermistor 75 or of the sub-thermistor 76 in the heating halt state of the heating body. Since the warmth of the fusing apparatus 607 can be estimated from the initial temperature of the main thermistor 75, the temperature threshold value of the sub-thermistor 76 can be determined in response to the estimated value.

Moreover, although the present embodiment is described by way of example of the film heat type fusing apparatus, this is not essential. As for the thermal roller type fusing apparatus, also, the problem of the conventional film heat system as described before is apt to occur when low heat capacity components are used to reduce the warm-up control time. In this case, the present invention can achieve similar advantages.

Second Embodiment

In the foregoing embodiment, the temperature threshold value of the sub-thermistor 76 is switched according to the paper count during the small size paper conveyance, and the successively conveyed paper count threshold value is fixed. However, the heating value and heating duration of the heater 73 can vary depending on the length of the small size paper in the conveyance direction, the width in the longitudinal direction, thickness and the multi feeding. Thus, the degree of the temperature rise of the sub-thermistor 76 and that of the press roller 74 can vary depending on the kind of paper, even for the same conveyance paper count. Accordingly, the fixed paper count threshold values are insufficient to decide the warmth of the fusing apparatus 607 in order to maximize the throughput of a variety of small size papers.

To solve the problem, the present embodiment employs a method of making a decision of the warmth around the sub-thermistor 76 by utilizing the non-paper conveyance duration (called "paper spacing" from now on) between successive small size recording mediums P and P', and of setting the temperature threshold value of the sub-thermistor 76 again in response to the decision. More specifically, the heating halt state of the heating body is defined as the heating halt state from the actuation command reception by the image generating apparatus to just before the heating start of the fusing apparatus, or as the state during which the fusing nip is not pinching the recording medium after the heating start of the fusing apparatus. Then the specified threshold value is determined according to the variations with time of the detection temperature of the main thermistor 75 or of the sub-thermistor 76 in the heating halt state. The remaining control is the same as that of the first embodiment.

Figure 9:
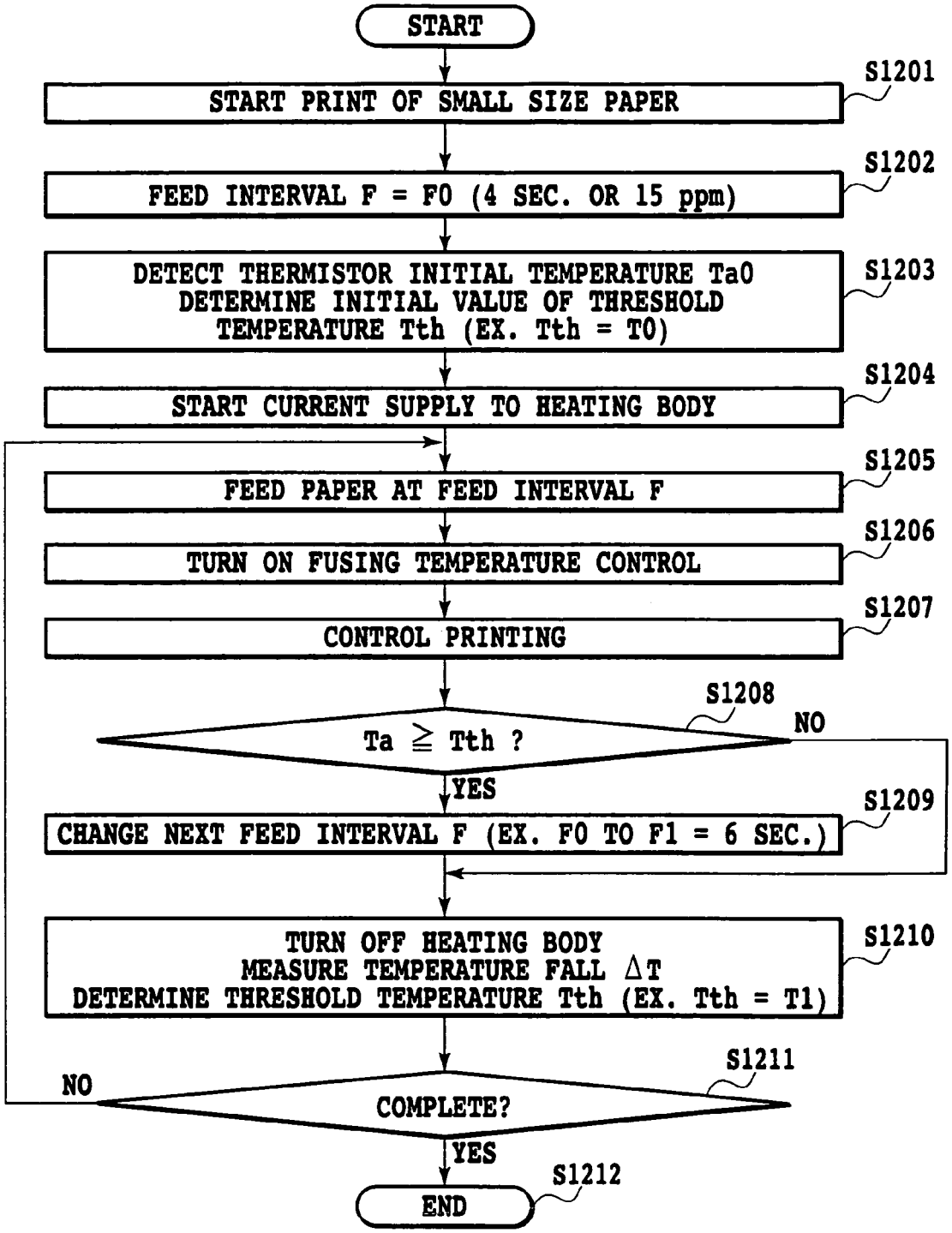
FIG. 9 is a flowchart of the control of an embodiment of the image generating apparatus in accordance with the present invention.

Next, the details of the main control performed by the temperature control means 20 of the present embodiment will be described with reference to the flowchart of FIG. 9. After receiving the small size paper print signal, the CPU detects the sub-thermistor initial temperature Ta0, and determines the sub-thermistor temperature threshold value Tth for switching the small size paper feed interval in accordance with Table 1 (S1201-S1203). Subsequently, the temperature control means 20 supplies current to the heater 73 at specified timing (S1204), and starts to feed the recording mediums P at the initial feed intervals F0=4 seconds (15 ppm) (S1205). Thus far the present embodiment has been the same as the first embodiment.

As for the control switching of the present embodiment, the temperature control means 20 does not carry out the successively conveyed paper count, but performs the normal fusing control and print control for the recording mediums (S1206 and S1207). Then, monitoring the temperature Ta of the sub-thermistor 76 while the recording medium P is passing through the fusing apparatus 607, the temperature control means 20 carries out the control of switching the feed interval F from the paper feed of the next recording medium, when Ta exceeds the sub-thermistor temperature threshold value Tth (S1208 and S1209).

During a specified time period, which is set at one second in the present embodiment, and corresponds to the paper spacing from the time when a first recording medium P passes through the fusing apparatus 607 to the time when a second recording medium is transported to the fusing apparatus 607, the temperature control means 20 turns off the current supply to the heater 73, and measures the falling temperature ΔT of the sub-thermistor 76. According to the value ΔT, the temperature control means 20 sets one of the sub-thermistor temperature threshold values Tth as shown in Table 2 again (S1210). The subsequently processing is the same as that of the foregoing first embodiment.

TABLE 2

| Sub-Thermistor Temperature Threshold Value Corresponding to Sub-Thermistor Temperature Drop | |
|---|---|
| \|ΔT\| | Tth |
| 50 deg < ΔT | T1 (260° C.) |
| 30 deg < ΔT ≦ 50 deg | T2 (250° C.) |
| 20 deg < ΔT ≦ 30 deg | T3 (240° C.) |
| ΔT ≦ 20 deg | T4 (235° C.) |

The temperature threshold value of the foregoing control is set by using the fact that when the heating is switched off while the fusing apparatus 607 is not warmed up, the degree of the heat radiation around the sub-thermistor 76 is large, that is, the falling temperature ΔT is large, whereas when the fusing apparatus 607 is warmed up, ΔT is small.

Using the present embodiment of the fusing apparatus makes it possible to estimate the degree of the warmth of the fusing apparatus 607 independently of the paper size or thickness, thereby being able to set the optimum temperature threshold value of the sub-thermistor 76. As a result, the effect and advantage of the first embodiment are optimized.

Although the present embodiment is described by way of example in which the falling temperature is measured and controlled in the paper spacing during the recording medium conveyance, this is not essential. For example, the falling temperature can be measured during the inactive state of the heater 73 such as during the rotation control after the print job or during the driving interruption after the print job, followed by the same control of the present embodiment.

In addition, although the present embodiment carries out the measurement of the temperature of the sub-thermistor 76 in terms of the falling temperature during the interruption of heating body current supply in the paper spacing, this is not essential. For example, since the degree of the warmth of the fusing apparatus 607 can be estimated by measuring the temperature of the main thermistor 75, the temperature threshold value of the sub-thermistor 76 can be determined in accordance with that measurement value.

The heating halt state of the heating body can be defined as the state from the actuation command reception by the image generating apparatus to immediately before the heating start of the fusing apparatus.

The present embodiment can further comprise a count means for performing the successively conveyed paper count of the recording mediums, and determine the specified threshold value in response to the successively conveyed paper count of the recording mediums by the count means.

In addition, the heating halt state of the heating body is defined as the heating halt state from the actuation command reception by the image generating apparatus to just before the heating start of the fusing apparatus, or as the state during which the fusing nip is not pinching the recording medium after the heating start of the fusing apparatus. The specified threshold value is determined in accordance with the change with time of the detection temperature of the first or second temperature detecting means in the heating halt state.

The switching control means can be a control means for prolonging the feed interval of the recording medium.

The switching control means can be a control means for reducing the heating value of the heating body or for halting the heating.

The switching control means can be a control means for reducing the driving velocity of the fusing apparatus.

The fusing apparatus can further comprise the fusing component including the thin film sliding on the heating body, and the pressing component for forming the fusing nip by press-contacting the heating body via the thin film. Thus, the fusing apparatus can pinch and transport by the fusing nip the recording medium on which the unfused image is formed, and fuse the unfused image on the recording medium as a permanent image using the heat supplied from the heating body via the thin film.

Third Embodiment

This Embodiment is characterized by the following points. That is, even when controling the feed interval in response to compared results of the detected temperature with a specified threshold temperature, the feed intervals are not changed when the number of the fed recording media is lower than the specified paper count, right after changing of the feed interval.

Figure 10:
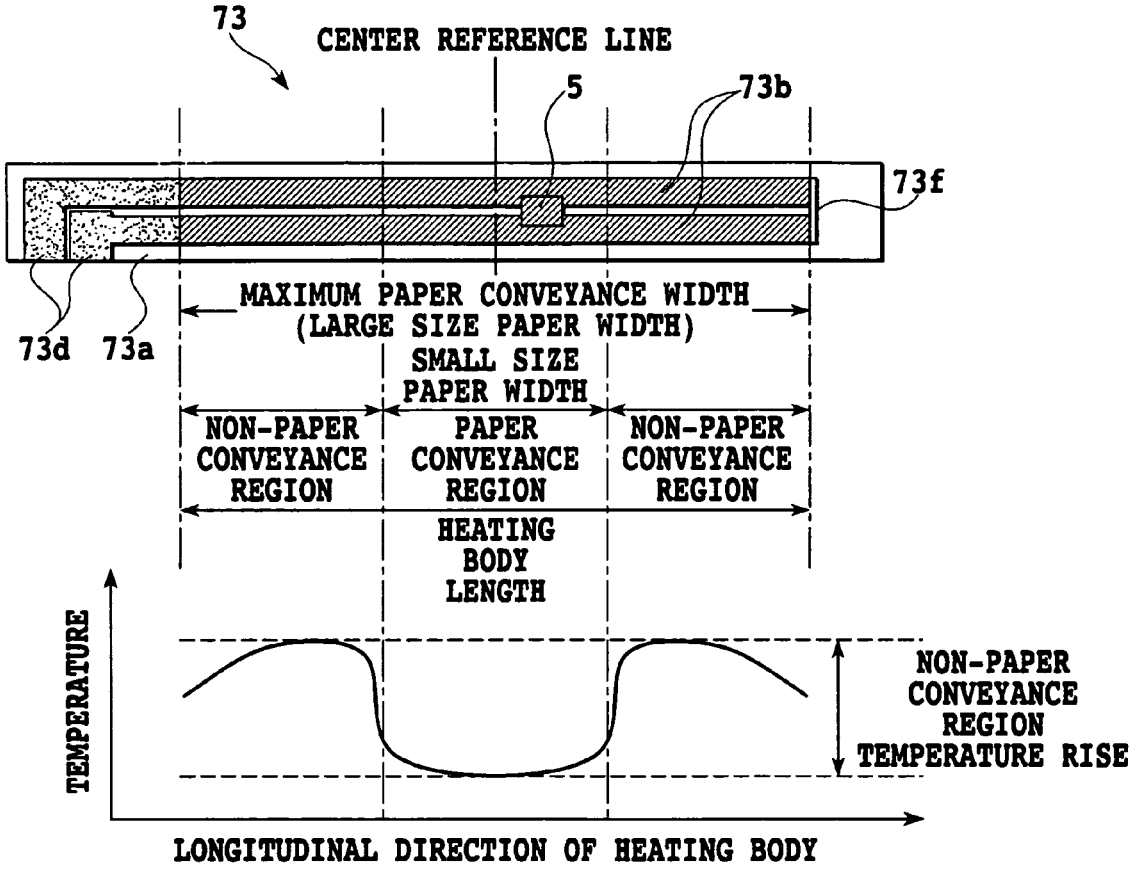
FIG. 10 is a diagram illustrating a temperature rise in non-paper conveyance regions in the longitudinal direction of the heater.

FIG. 10 is a schematic diagram showing an example using a ceramic heater as the heating body. The heater 73 includes as its basic components a heater substrate 73*a*, and a resistance heating element pattern (current supply heating element) 73*b* that is formed on a surface of the heater substrate and generates heat by current supply.

The heater substrate 73*a*, which has the longitudinal direction perpendicular to the conveyance direction, is a horizontally oriented, thin component consisting of a material such as aluminum nitride or alumina with such characteristics as high heat resistance, low heat capacity, good heat conduction, and electric insulation.

The resistance heating element pattern 73*b*, which is formed in the longitudinal direction on the heater substrate, is composed of an electric resistance element such as silver palladium or $Ta_2N$ that generates heat by current supply. The heater includes two parallel resistance heating element patterns 73*b* having their ends electrically connected via a conductive pattern 73*f* at one side. The individual resistance heating element patterns 73*b* are connected to feeding electrode patterns 73*d* at the other side, through which the resistance heating element patterns 73*b* are supplied with a current from a supply circuit not shown to generate heat. The temperature of the heater 73 rises sharply because of the heat generation by the resistance heating element patterns 73*b*.

The thermistor 5 detects the temperature of the heater 73. The thermistor 5 is mounted on the opposite side of the heater substrate 73*a* on which the resistance heating element patterns 73*b* are formed. It detects the heater temperature and notifies the control circuit of the detected temperature. The control circuit controls the heater temperature by regulating the current supply from the supply circuit to the resistance heating element patterns 73*b* in order to maintain the heater temperature detected by the thermistor 5 at a specified target temperature (fusing temperature).

In the present example, the paper conveyance is carried out by the center reference conveyance, and the thermistor 5 is placed at a location in the longitudinal direction of the heater in the paper conveyance region, through which any sizes of recording mediums pass during the paper conveyance. To achieve good fusing characteristics without failure, the thermistor 5 observes the temperature of the paper conveyance region, and notifies the control circuit of the detection temperature to be fed back to the current supply control of the heater.

Consider the case where the image generating apparatus successively conveys recording mediums with a rather narrow width such as an envelope or postcard (called "small size paper" from now on) compared with the width of the heating area of the fusing apparatus. In this case, the amount of heat absorbed differs greatly in the paper conveyance region and non-paper conveyance regions. The temperature of the non-paper conveyance regions, from which the recording mediums do not absorb heat, gradually increases during the paper conveyance, thereby bringing about the so-called non-paper conveyance region temperature rise phenomenon. The excessive non-paper conveyance region temperature rise has adverse effect such as damaging the components of the fusing apparatus by heat, and reducing the life of the apparatus.

FIG. 10 illustrates behavior of the non-paper conveyance region temperature rise in the longitudinal direction of the heating element. The temperature of the paper conveyance region is controlled at a constant temperature by the heat supplied from the heater in spite of the loss of heat by the recording mediums. In contrast, since the non-paper conveyance regions are supplied with heat rather than lose it, the temperature rises beyond the fusing control temperature. The non-paper conveyance region temperature rise is greater as the paper is narrower and thicker. The high temperature of the non-paper conveyance regions can bring about thermal degradation of the components of the fusing apparatus such as the press roller. In addition, when recording mediums of the normal paper size are conveyed in the condition of the non-paper conveyance region temperature rise, the edge hot offset can occur because of the excessively high temperature in the non-paper conveyance regions.

In view of this, a variety of control methods have been proposed such as varying the feed intervals in response to the non-paper conveyance region temperature rise detected by the sub-thermistor at the edge, or reducing the conveyance speed or interrupting the power supply to the heater. To increase the throughput of the initial paper conveyance, a method is widely used of lengthening the paper feed intervals stepwise during the successive paper conveyance.

The following two methods are actually used as a control method of extending the paper feed intervals during the successive paper conveyance.

(1) Control of Extending Paper Feed Intervals by the Number of Conveyed Papers (Paper Count Switching Control).

It is a method of extending the paper feed intervals stepwise according to the number of conveyed recording mediums (the so-called "paper count switching control").

As for paper counts at which the paper feed intervals are extended, they are determined as follows and incorporated into the control in advance. Each of such paper counts is determined such that even when the recording mediums such as com10#582 envelopes (105 mm wide×241 mm long) are used which are very severe with the non-paper conveyance region temperature rise, the paper feed interval is extended at the number of conveyed papers, which can prevent the thermal degradation in the fusing apparatus.

As a means for counting the number of conveyed recording mediums, a photo-interrupter can be used. The passage of the recording mediums detected is transmitted to the control means by the electric signal, and the control means counts the number of conveyed papers.

Table 3 shows individual preset values of the conventional paper count switching control. In the example, the paper feed intervals have their stage K divided into four stages which are switched such as K1→K2→K3→K4 according to the number of conveyed papers Q.

TABLE 3

Preset Values of Conventional Paper Count Switching Control

| | Stages of paper feed interval K | | | |
|---|---|---|---|---|
| | K1 | K2 | K3 | K4 |
| Number of conveyed papers Q | 1–5 | 6–20 | 21–50 | 51- |
| Paper feed intervals | 5 sec. | 10 sec. | 15 sec. | 30 sec. |

Figure 11:
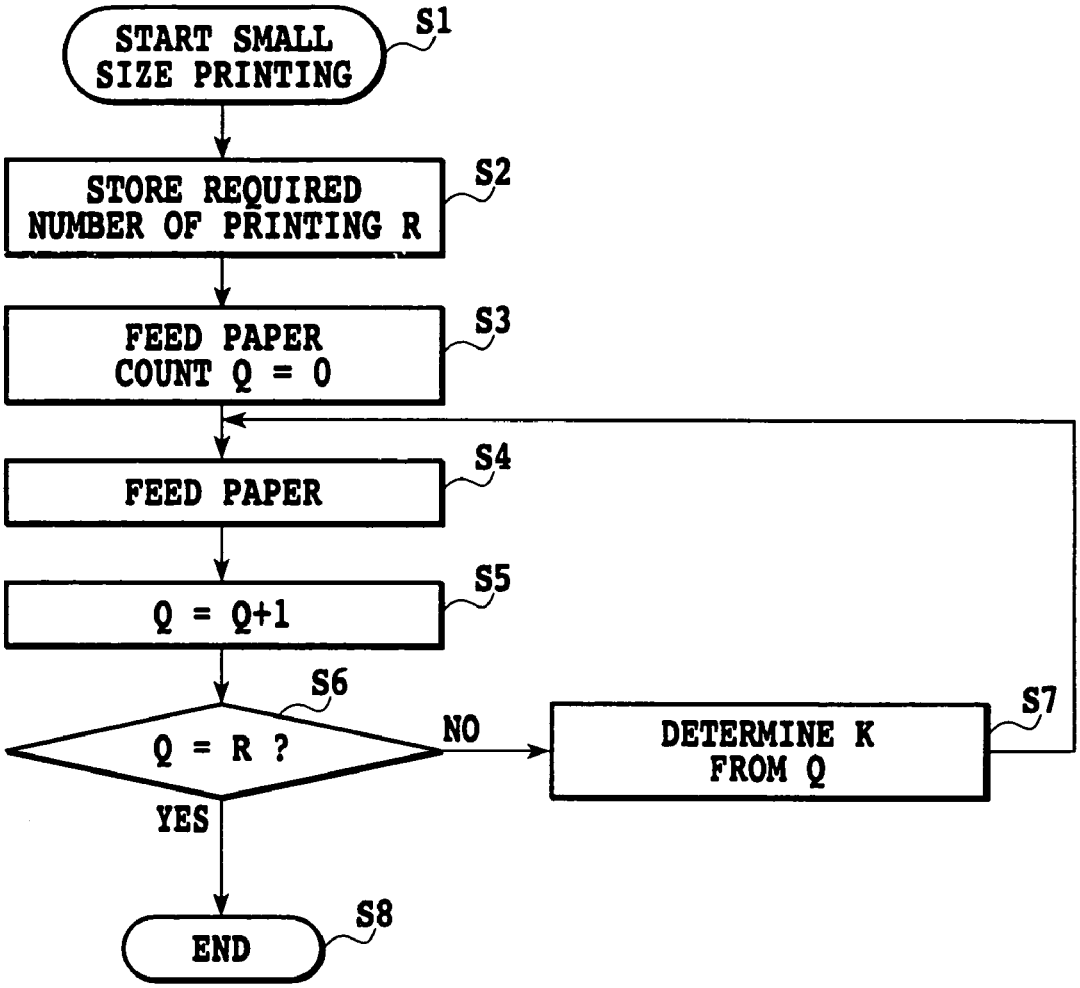
FIG. 11 is a flowchart of conventional paper count switching control.

FIG. 11 shows a flowchart of the conventional paper count switching control. At step S1, small size paper printing is started. At step S2, a required print paper count R is stored. At step S3, a paper feed count Q is cleared (Q=0). At step S4, the paper is fed. At step S5, the means for counting the number of conveyed papers counts the number of conveyed papers (Q=Q+1). When the number of conveyed papers Q does not reach the required print paper count R at step S6, the stage K of the paper feed interval is determined according to the number of conveyed papers Q of Table 3 at step S7, and the paper feed is carried out again according to the paper feed interval (step S7→step S4). When the number of conveyed papers Q reaches the required print paper count R at step S6, all the print control is completed after a test paper is output from the image generating apparatus (step S8).

In this way, the paper feed intervals are extended stepwise according to the number of conveyed papers. This makes impossible to prevent the non-paper conveyance region temperature rise in spite of the successive paper conveyance of small size papers, thereby being able to prevent the thermal degradation of the press roller, and image degradation due to the non-paper conveyance region temperature rise.

Such conventional paper count switching control, however, has a problem in that even for the successive paper conveyance of small size papers having a rather mild non-paper conveyance region temperature rise (such as wide, thin recording mediums like EXE and B5 size thin papers), it extends the paper feed intervals stepwise at the same paper counts as the small size papers, which have the sharp non-paper conveyance region temperature rise.

(2) Control of Switching Paper Feed Interval by Detecting Temperature of Non-Paper Conveyance Sections (Temperature Switching Control).

In the market, the frequency of using papers such as com10 envelopes is considerably lower than that of using thin papers such as B5 or EXE size. In view of this, to increase the throughput of the B5 size and EXE size that are more widely used among the small size paper, the so-called temperature switching control was invented and has been used actually. It focuses attention on the fact that the non-paper conveyance region temperature rise varies depending on the recording mediums, and detects the non-paper conveyance region temperature rise by a second temperature detecting means to carry out the switching control of the paper feed intervals stepwise. Such control is disclosed in Japanese Patent Application Laid-open No. 5-080604(1993), for example.

Figure 12:
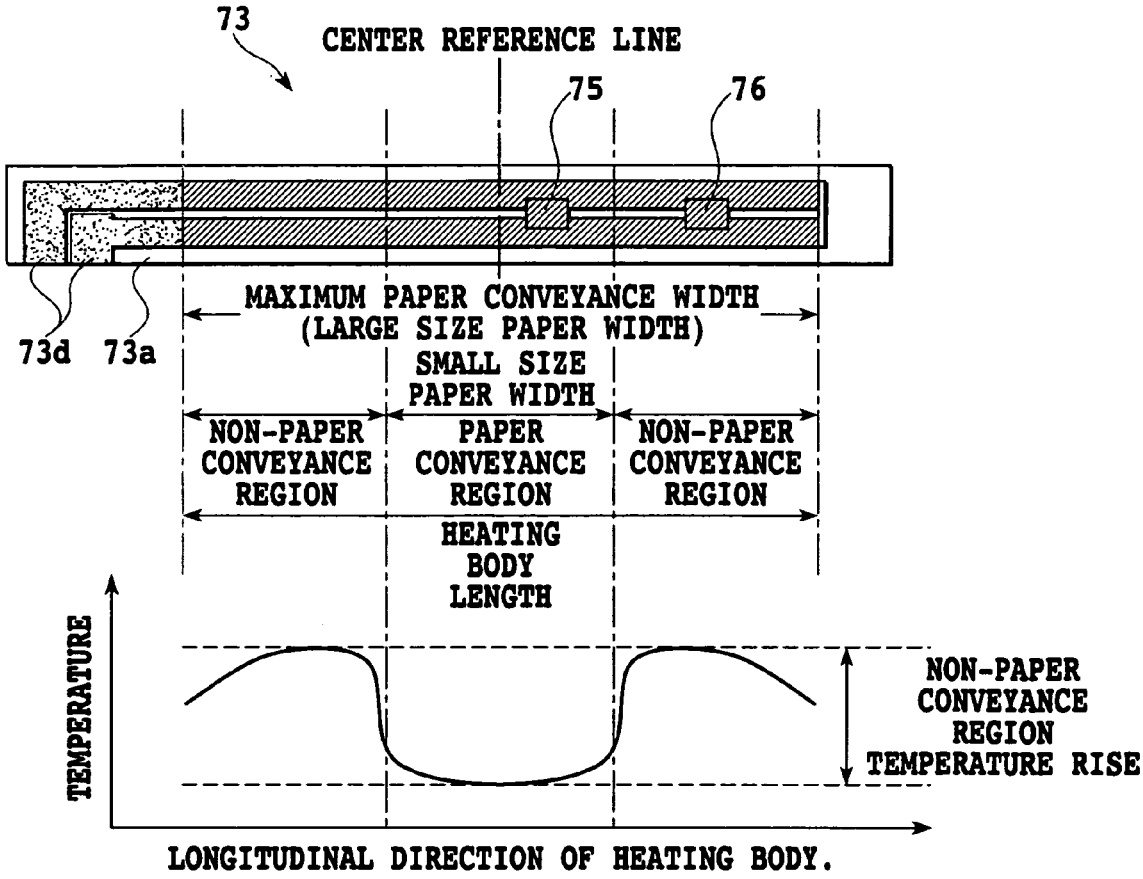
FIG. 12 is a diagram showing a placement of two thermistors.

Assume that the foregoing temperature detecting means is the main thermistor, and the present temperature detecting means is the sub-thermistor. The configuration of placing two or more temperature detecting means in the fusing apparatus has been proposed and implemented already. FIG. 12 shows the placement of the two temperature detecting means. The main thermistor 75 is placed in the paper conveyance region, through which all the recording mediums of any sizes are conveyed. The main thermistor 75 observes the temperature of the paper conveyance region, and transmits information on the detection temperature to the control circuit to feed it back to the current supply control of the heater to achieve the good fusing characteristics without fail. On the other hand, the sub-thermistor 76 is placed in the non-paper conveyance region of the small size papers. It detects the non-paper conveyance region temperature rise to enable the temperature switching control. In addition, it serves to prevent the thermal degradation or damage of the fusing apparatus by detecting unusual high temperature of the heater 73 due to a malfunction of the main thermistor 75, or by detecting the multi feeding of the recording mediums, for example.

Table 4 shows the individual design values of the conventional temperature switching control.

TABLE 4

| Preset Values of Conventional Temperature Switching Control | | | | |
|---|---|---|---|---|
| | Paper feed interval Stages K | | | |
| | K1 | K2 | K3 | K4 |
| Paper feed intervals | 5 sec | 10 sec | 15 sec | 30 sec |
| Threshold temperature a | | 220° C. | | undefined |

The example sets the threshold temperature a=220° C. for the maximum temperature Tmax of the detection temperature T of the second temperature detecting means 76, and extends the paper feed interval stages K as K1→K2→K3→K4 when Tmax exceeds 220° C.

Figure 13:
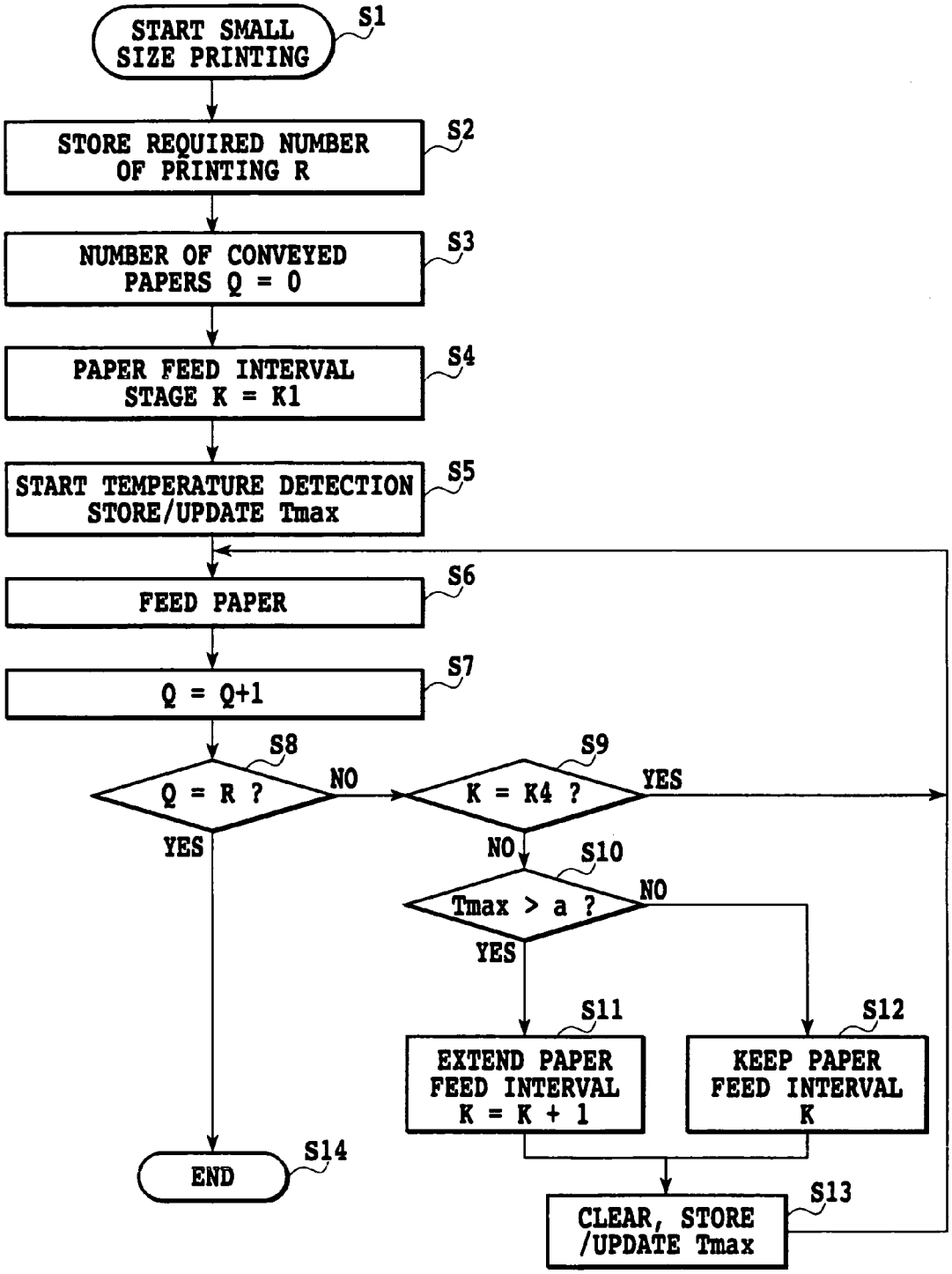
FIG. 13 is a flowchart of conventional temperature switching control.

FIG. 13 shows a flowchart of an ordinary temperature switching control means. Steps S1-S3 are the same as those of the foregoing paper count switching. At step S4, the paper feed interval stage of the initial paper conveyance is assumed to be K1. At step S5, the sub-thermistor starts temperature detection, and continues storing and updating the maximum temperature Tmax of the detection temperature T. Steps S6-S8 are the same as their counterparts of the paper count switching control. At step S9, if the present paper feed interval stage K is not K4, the processing proceeds to step S10, at which a decision is made as to whether Tmax does not exceed the threshold temperature a=220° C. (see Table 4). If Tmax>220° C., the paper feed interval is extended at step S11 (K=K+1). Otherwise, the paper feed interval is maintained (step S12). If K=K4 at step S9, the paper feed interval is not extended because K4 is the longest paper feed interval stage. At step S13, Tmax is deleted once, and the maximum temperature Tmax of the successively detected temperature T is stored and updated continuously. Subsequently, according to the paper feed interval determined at step S11 or S12, the paper feed is carried out again (step S13→step S6). If the number of conveyed papers Q reaches the required print paper count R at step S8, the entire print control is completed after outputting the test paper from the image generating apparatus (step S14).

The foregoing temperature switching control presents the following problem when deciding the extension of the paper feed interval of the subsequent paper before the rear edge of the previous paper is released from the fusing nip to further increase the throughput by reducing the paper feed interval.

Figure 14:
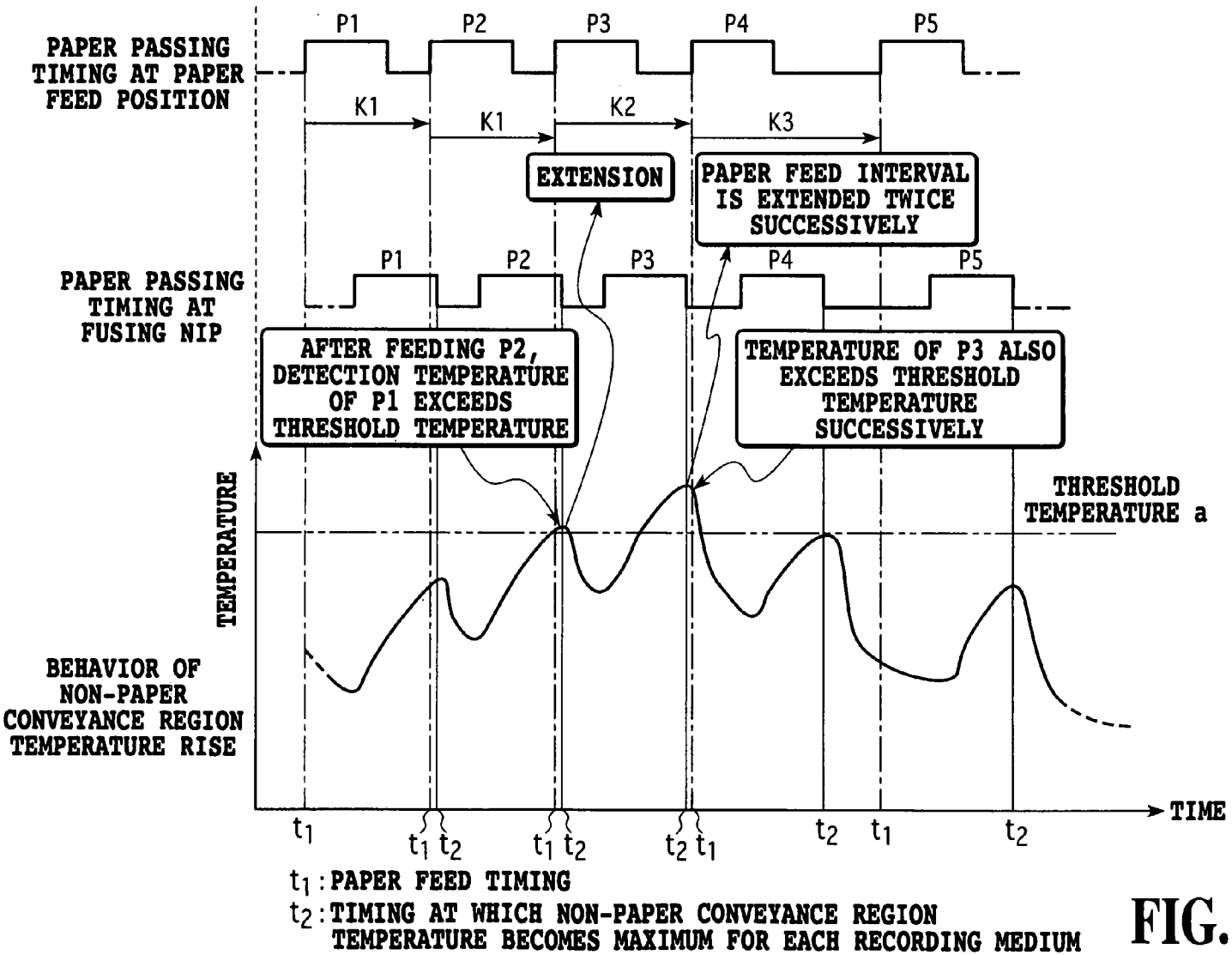
FIG. 14 is a timing chart illustrating a paper feed timing, a paper passing timing across the fusing nip, and a timing at which the non-paper conveyance regions become highest in temperature.

Consider the case where recording mediums are successively fed such as . . . →P1→P2→P3→P4→P5→ . . . , while the initial paper feed interval K1 is set at such a short interval as the subsequent paper is fed before the rear edge of the previous paper leaves the fusing nip by using the conventional temperature switching control (see, FIG. 12 and Table 4). FIG. 14 illustrates the paper feed timings and the timings at which the temperature of the non-paper conveyance region becomes maximum for individual recording mediums, where the horizontal axis represents the elapsed time.

As for the timing of deciding the extension of the paper feed interval, assume that it is just before the paper feed timing ($t_1$ of FIG. 14).

The timing at which the non-paper conveyance region takes the highest temperature for each recording medium is the point at which the rear edge of the recording medium leaves the fusing nip ($t_2$ of FIG. 14). This is because while the recording medium is passing through the fusing nip, the paper conveyance region is continuously deprived of the heat by the recording medium, whereas the non-paper conveyance region is continuously supplied with the heat from the heating element.

Accordingly, as illustrated in FIG. 14, it is likely that the detection temperature T of the recording medium P2 exceeds the threshold temperature a after the recording medium P3 is fed. In this case, since the paper feed interval of the recording medium P3 is not extended, the detection temperature T of the recording mediums P3 exceeds the threshold temperature a (T>a). As a result, the extension of the paper feed interval is carried out twice successively for the recording mediums P4 and P5, and thus the throughput is reduced more than necessary.

As for the extension of the paper feed interval, the present example "can delay the decision of the extension just before the next paper feed". In contrast, some of the widely used image generating apparatuses make the decision of the extension "when detecting the conveyance of the previous recording medium". For example, they employ the photo-interrupter described in the paper count switching control, and carry out the paper feed of the subsequent paper after confirming the normal paper feed and conveyance of the previous paper. The latter control makes a decision as to the extension of the paper feed interval earlier than the former control, and hence it also extends the paper feed interval twice successively.

Figure 15:
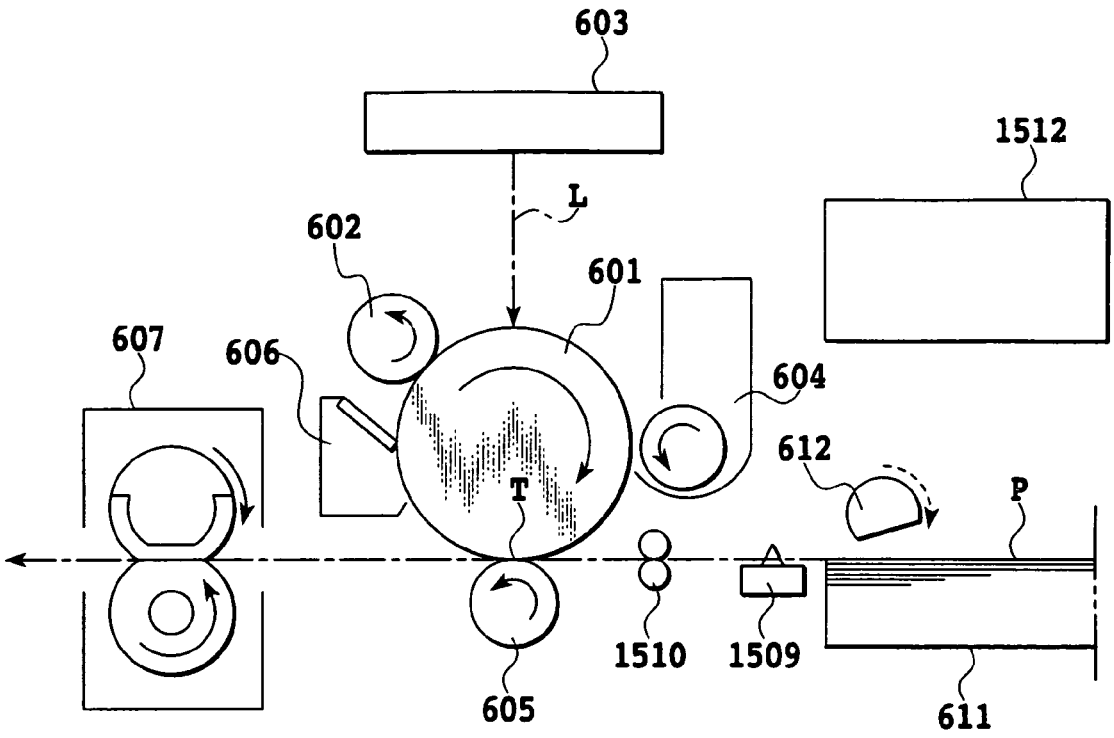
FIG. 15 is a schematic view showing an embodiment of the image generating apparatus in accordance with the present invention.

FIG. 15 is a schematic diagram showing a structure of the third embodiment of the image generating apparatus in accordance with the present invention. In FIG. 15, the same reference numerals as those of FIG. 3 designate the same components.

A conveyed paper count means 1509 is installed along a recording medium conveyance path at the downstream side of the paper feed cassette 611 and at the upstream side of the resist roller pair 1510 in the recording medium conveyance direction. The photo-interrupter is used as the conveyed paper count means in the present example.

The photo-interrupter is composed of an emitting section, a receiving section, and a rod-like oscillating member. The emitting section and receiving section face each other. The emitting section is supplied with a voltage from the control circuit, and emits an optical signal toward the receiving section. The oscillating member is disposed such that it can swing between the emitting section and receiving section. The other end of the oscillating member protrudes to the conveyance path of the recording medium so that the oscillating member oscillates by making contact with the recording medium passing through the path. The passage of the recording medium is detected when the oscillating member oscillates in such a manner that it interrupts or passes the optical signal emitted from the emitting section to the receiving section. The passage of the recording medium detected is transmitted to the control means as an electric signal, and the control means counts the number of conveyed papers.

The control circuit (control board) 1512, the control means, controls all the image formation process units of the image generating apparatus, and implements the image formation sequence control.

Figure 16:
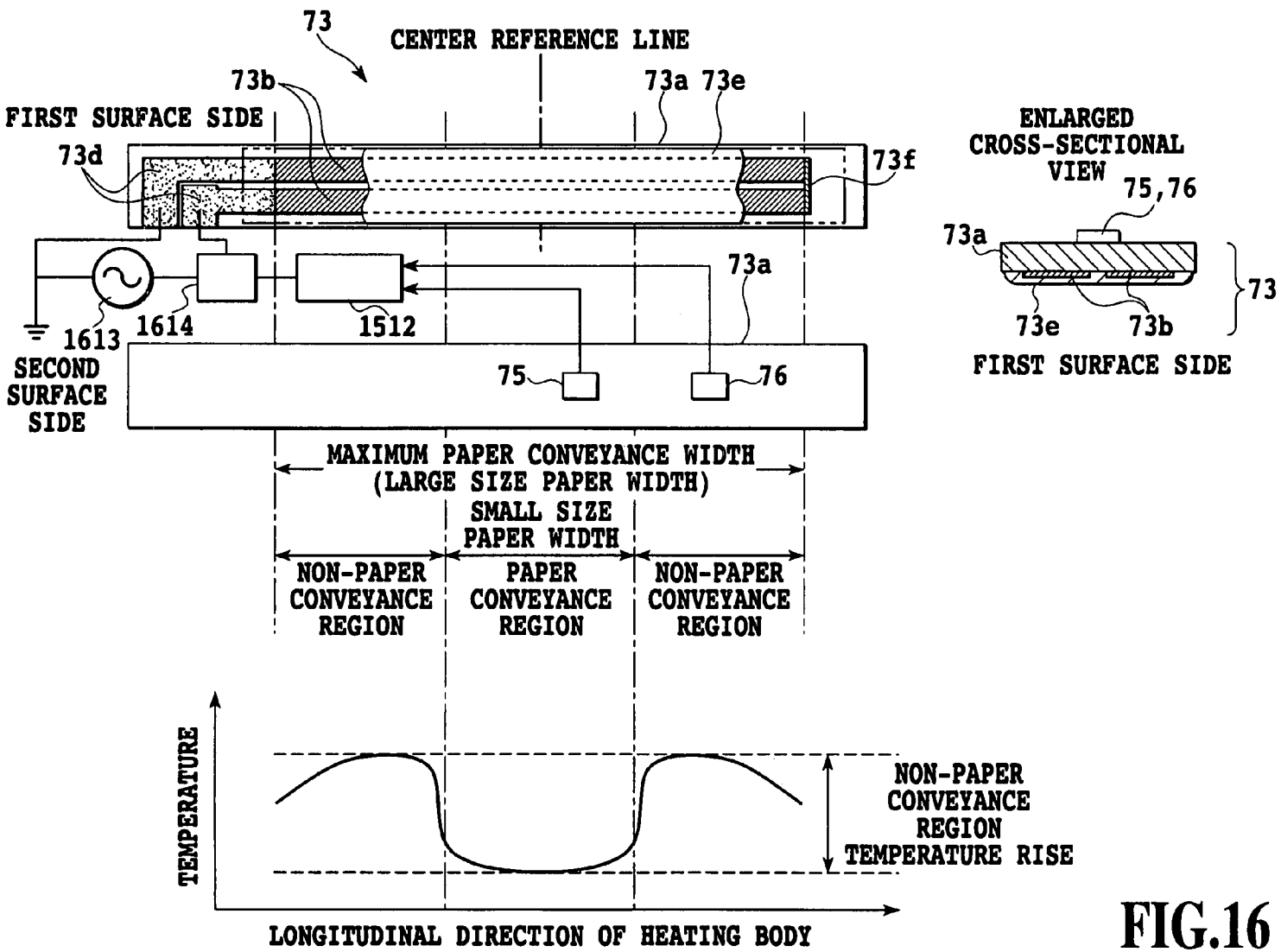
FIG. 16 is a schematic diagram showing a structure of a ceramic heater as a heating body.

FIG. 16 is a schematic diagram showing a structure of the heater 73 used in the present example. The heater 73 comprises:

(1) an aluminum nitride substrate of 7 mm wide×235 mm long×1.0 mm thick serving as the heater substrate 73*a;*

(2) two parallel resistance heating element patterns 73*b* with a resistance of 11 Ω, which is formed in the longitudinal direction on the surface of the heater substrate by making screen printing of an electric resistance paste such as silver palladium (Ag/Pd);

(3) a conductive pattern 73*f* for electrically connecting one-side ends of the two parallel resistance heating element patterns 73*b* so that they are connected in series;

(4) feeding electrode patterns 73*d* electrically connected to the other-side ends of the individual resistance heating element patterns 73*b*; and (5) an insulator coated sliding layer 73*e* such as a thin glass coating layer that covers the resistance heating element patterns 73*b* and conductive pattern 73*f* on the surface of the heater substrate.

On the second surface of the heater substrate 73*a*, the main thermistor 75 and sub-thermistor 76 are mounted to monitor the heater temperatures.

The heater 73 is inserted and fixed in a heater insertion groove, which is formed along the bottom center of the film guide 72 in its longitudinal direction, with the heater surface side exposed to the outside.

In the present example, the paper conveyance is carried out by the center reference conveyance, and the main thermistor 75 is placed in the paper conveyance region, through which any sizes of recording mediums pass during the paper conveyance. To achieve good fusing characteristics without failure, the main thermistor 75 observes the temperature of the paper conveyance region, and notifies the control circuit 1512 of the detection temperature to be fed back to the current supply control of the heater 73. On the other hand, the sub-thermistor 76 is placed at a location in the non-paper conveyance region of a small size medium. The main thermistor 75 and sub-thermistor 76 are placed on the locations at 15 mm and 97 mm from the center of the heating element in its longitudinal direction on the opposite side of the feeding electrode patterns 73*d*. In the present example, external contact type thermistors are employed as the thermistors 75 and 76. The two thermistors 75 and 76 are press-contacted onto the heater 73 by a spring with a pressure of about one Newton.

It is also possible to use thermistors including a temperature detecting element whose resistance varies with temperature as the thermistors 75 and 76, for example. As a temperature detecting method, it is possible to use the following scheme. A temperature detecting element and a resistor whose resistance is known are incorporated into an electric circuit connected to the control means. The electric circuit is supplied with a very weak constant voltage, and the divided voltage across the resistor whose resistance is known is measured to know the detection temperature of the temperature detecting element.

Figure 17A:
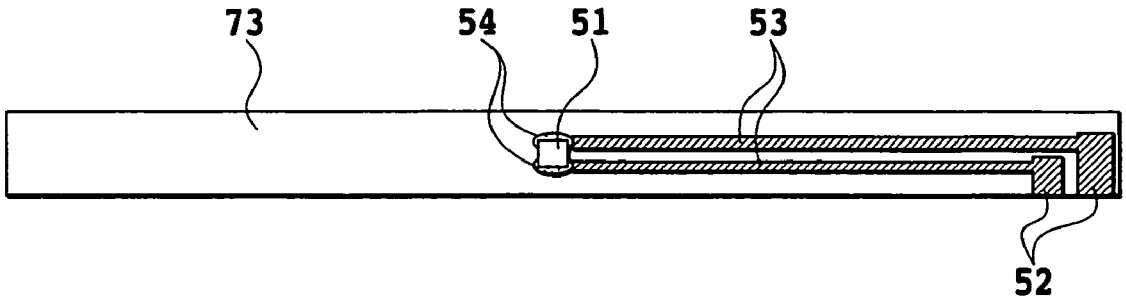
FIG. 17A is a schematic view showing a heater-integrated type thermistor.
Figure 17B:
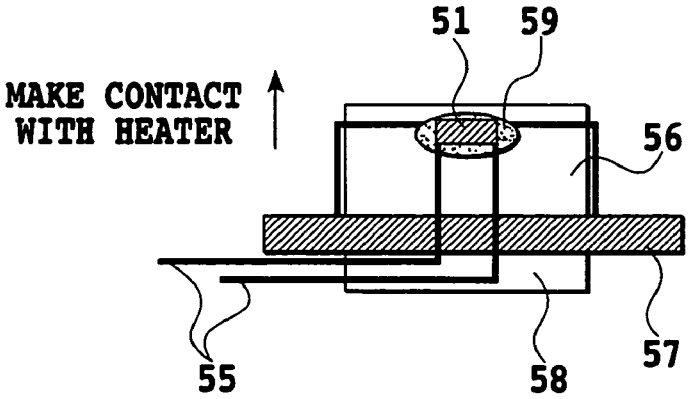
FIG. 17B is a schematic view showing an external contact type thermistor.

The thermistors are roughly divided into heater-integrated type and external contact type, both of which are widely used. FIG. 17A is a schematic view showing a heater-integrated type thermistor, and FIG. 17B is a schematic view showing an external contact type thermistor.

The heater-integrated type thermistor comprises on the heater 73 a temperature detector 51, an electrode section 52 composed of a silver paste or the like, and a conductive section 53. The temperature detector 51 is bonded to the conductive section 53 and heater 73 with solder 54. The temperature detector 51 is supplied with a voltage from outside via the electrode section 52 and conductive section 53.

The external contact type thermistor, which consists of a thermistor unit independent of the heater, includes the temperature detector 51, an electric circuit 55 composed of Dumet wires, a ceramic paper 56 with heat insulating, electrical insulating and elastic characteristics, a supporting body 57 composed of a heat resistant resin, an insulating film 58 such as a Kapton sheet, and an adhesive 59 such as a gasket.

Although the present example uses the external contact type thermistors as the main thermistor 75 and sub-thermistor 76, the heater-integrated type thermistors are also applicable by setting the preset values for switching the paper feed intervals to appropriate values, which will be described later.

The main thermistor 75 and sub-thermistor 76 supply their heater temperature detection information to the control circuit 1512. According to the detection information of the main thermistor 75, the control circuit 1512 controls the feeder circuit including an AC power supply 1613 and a triac 1614. Specifically, it regulates the heater temperature by controlling the supply power to the resistance heating element patterns 73*b*, thereby maintaining the heater temperature detected by the main thermistor 75 at specified target temperature (fusing temperature).

According to the detection information of the sub-thermistor 76, the control circuit 1512 controls the paper feed interval switching, which will be described in the following part (3).

According to the recording medium passage detection signal output from the conveyed paper count means 1509, the control circuit 1512 counts the number of conveyed papers.

Besides the foregoing operations, the control circuit 1512 controls all the image formation process units of the image generating apparatus, and conducts the image formation sequence control.

Table 5 shows the individual preset values of the paper feed interval switching control of the present embodiment.

TABLE 5

Preset Values of Paper Feed Interval Switching Control of Third Embodiment.

| | Paper feed interval Stages K | | | |
|---|---|---|---|---|
| | K1 | K2 | K3 | K4 |
| Paper feed intervals | 5 sec | 10 sec | 15 sec | 30 sec |
| Paper count α | 0 | 2 | | undefined |
| Threshold temperature a | | 210° C. | | |

The example specifies four stages as the paper feed interval stages K and sets the threshold temperature at a=210° C. for the maximum temperature Tmax of the detection temperature T of the sub-thermistor 76, and extends the paper feed interval stages K as K1→K2→K3→K4 when Tmax exceeds 210° C.

The present embodiment is characterized by setting a specified paper count α, and does not extend the paper feed interval even if Tmax>210° C. during a sheets of paper after exceeding the threshold temperature a.

To achieve this, the present embodiment makes the paper count θ successively conveyed at the same paper feed intervals, and sets the specified paper count α for the paper count θ. The specified paper count α is preset at zero for the paper feed interval stage K1 at the initial paper conveyance.

To determine the additional specified paper count α, the successive paper conveyance as shown in FIG. 14 is carried out with the conventional temperature switching means using the COM10 envelopes that bring about sharp non-paper conveyance region temperature rise. Then, the number of the recording mediums that brings about T>a is determined by counting from the recording medium next to the count at which the detection temperature T exceeds the threshold temperature a for the first time.

Assume that the first paper at which T exceeds a is P2. Then at P3, always T>a, and at P4, the paper feed interval is extended. Accordingly, the temperature starts to fall from P3, and drops below the temperature a at P5.

Consequently, the paper count can be set at α=2 (corresponding to P3 and P4) for ignoring the switching of the paper feed interval even though the temperature T exceeds the threshold temperature a. In addition, the threshold temperature a is determined such that even at P3 at which the non-paper conveyance region takes the highest temperature, the press roller temperature does not reach the thermal degradation temperature, and the image degradation due to the non-paper conveyance region temperature rise does not occur.

Figure 18:
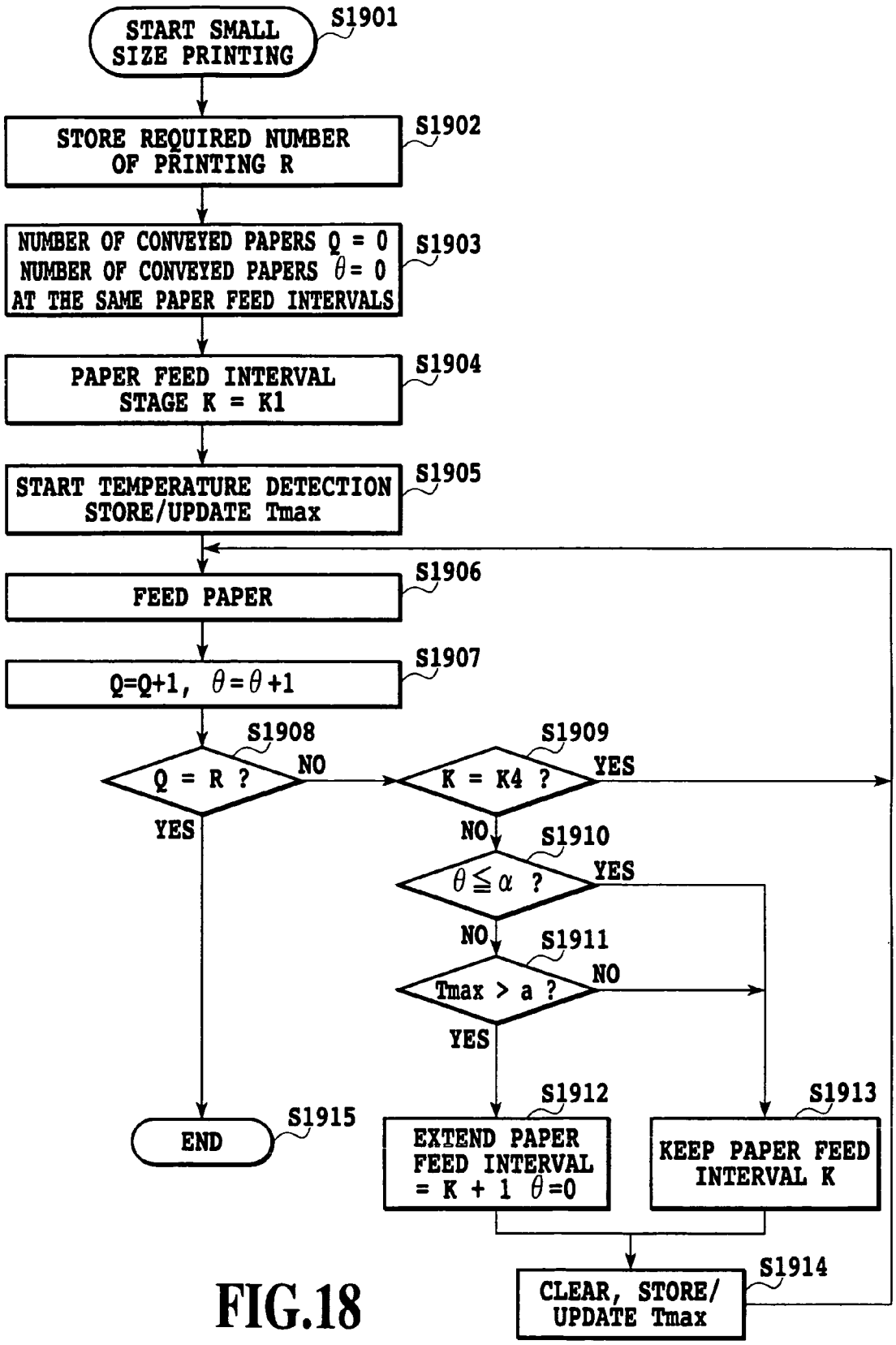
FIG. 18 is a flowchart of the paper feed interval switching control of the embodiment in accordance with the present invention.

FIG. 18 is a flowchart of the paper feed interval switching control of the present embodiment. At step S1901, the print operation of the small size paper is started. At step S1902, the required print paper count R is stored. At step S1903, then umber of conveyed papers Q and the number of conveyed papers θ at the same paper feed intervals are cleared (Q=0 and θ=0). At step S1904, the stage K of the paper feed interval of the initial paper conveyance is set at K1. At step S1905, the sub-thermistor 76 starts its temperature detection. Here, the maximum value of the successively detected temperature T is continuously stored and updated as Tmax.

At step S1907, the photo-interrupter counts the number of conveyed papers Q, and the number of conveyed papers θ at the same paper feed interval (Q=Q+1 and θ=θ+1). At step S1908, when the number of conveyed papers Q has not yet reached the required print paper count R, the processing proceeds to step S1909. At step S1909, if the stage K of the present paper feed interval is not K4, a decision is made as to whether θ≦α at step S1910.

From Table 5, α=2. If θ≦α, the stage of the paper feed interval is not changed. Otherwise, a decision is made as to whether Tmax exceeds the threshold temperature a=220° C. at step S1911 (see, Table 5). If Tmax>220° C., the paper feed interval is extended at step S1912 (K=K+1), and the number of conveyed papers θ at the same paper feed intervals is cleared (θ=0). If Tmax>a does not hold, the paper feed interval is not changed (step S1913).

At step S1909, if K=K4, the extension of the paper feed interval is not carried out because K4 is the final stage of the paper feed intervals. When the paper feed interval is determined at step S1912 or S1913, Tmax is once cleared at step S1914, and the maximum value Tmax of the successively detected temperature T is stored and updated. According to the paper feed interval determined at step S1912 or S1913, the paper feed is carried out again (step S1914→step S1906). At step S1908, if the number of conveyed papers Q reaches the required print paper count R, the entire print control is completed after outputting the test paper from the image generating apparatus (step S1915).

Figure 19A:
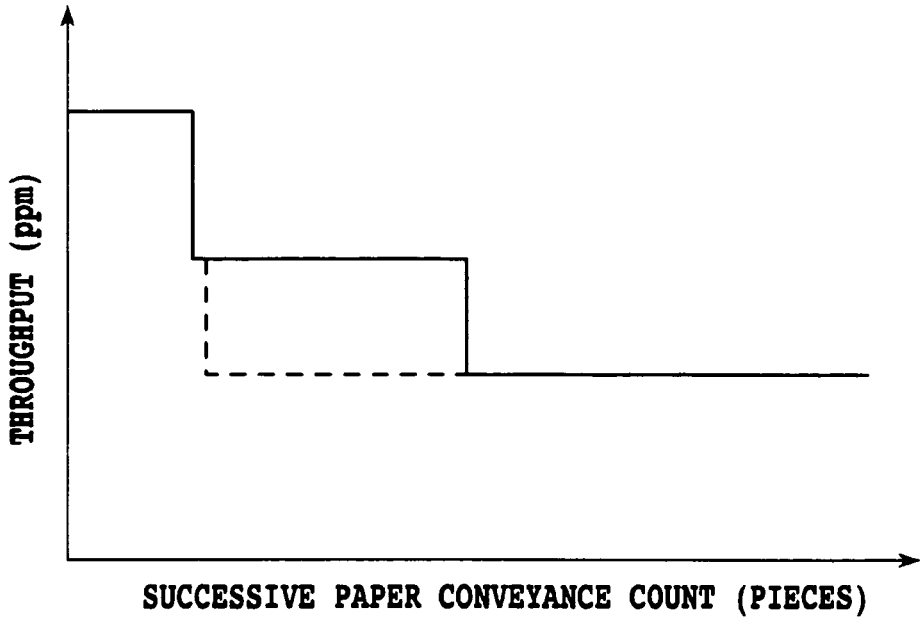
FIGS. 19A and 19B are diagrams illustrating an effect 1 of the embodiment in accordance with the present invention.
Figure 19B:
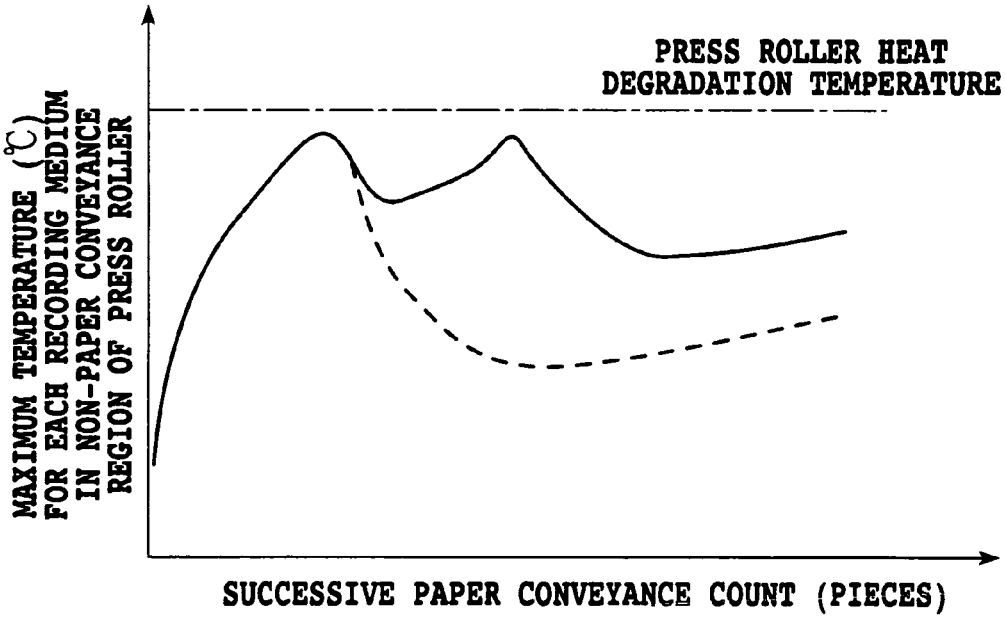

FIGS. 19A and 19B illustrate an effect 1 of the present embodiment when the throughput of the initial successive paper conveyance is increased: FIG. 19A illustrates the changes of the throughput during the successive paper conveyance; and FIG. 19B illustrates the maximum temperature of the non-paper conveyance region of the press roller for each recording medium. The solid lines represent the behavior of the paper feed interval switching control of the present embodiment, and the broken lines represent that of the conventional temperature switching control. The conventional temperature switching control extends the paper feed intervals twice successively. In contrast, the paper feed interval switching control of the present embodiment does not extend the paper feed interval successively, thereby enabling the press roller temperature to make transition at the stable temperature below the thermal degradation temperature. In other words, the control of the present embodiment can increase the throughput with preventing the thermal degradation of the press roller. In addition, it can prevent the image degradation due to the non-paper conveyance region temperature rise, thereby being able to solve the problems.

Although the present embodiment sets the specified paper count α at the same value α=2 for the stages K=K2 and K3 of the paper feed intervals, it is also possible to set different values for the individual stages of the paper feed intervals.

Fourth Embodiment

As for the specified paper count α after extending the paper feed interval in the embodiment 3, it is a value for the control during which the paper feed interval is not switched regardless of the threshold temperature a. However, considering the worst case where an unknown recording medium, with which the non-paper conveyance temperature rise is sharper than with the COM10 envelope, is conveyed, or where the recording medium undergoes the multi feeding, the control is preferable which can extend the paper feed interval for the paper count corresponding to the foregoing α. In view of this, the present embodiment prepares not only α of the embodiment 1, but also a second threshold temperature b (b>a), which differs from the foregoing threshold temperature a so that when the detection temperature T exceeds the threshold temperature b during the paper conveyance using the specified paper count α, the paper feed interval is extended.

Table 6 shows the individual preset values of the paper feed interval switching control of the present embodiment.

TABLE 6

Preset Values of Paper Feed Interval Switching Control of Fourth Embodiment.

| | Paper feed interval Stages K | | | |
|---|---|---|---|---|
| | K1 | K2 | K3 | K4 |
| Paper feed intervals | 5 sec | 10 sec | 15 sec | 30 sec |
| Paper count α | 0 | 2 | | undefined |
| Threshold temperature a at θ > β | 210° C. | | | |
| Threshold temperature b at θ ≦ β | 220° C. | | | |

Here, β is the specified paper count to be compared with the paper count θ. The specified paper count α and threshold temperature a are determined as in the embodiment 1. As for the threshold temperature b, it is determined to satisfy the following three requirements in FIG. 14. First, it meets the condition b>T, where T is the detection temperature of P2, even when the COM10 envelopes are successively conveyed. Second, the threshold temperature b is set at a value lower than the detection temperature when the press roller reaches the thermal degradation temperature. Third, it is set at a value that can prevent the image degradation due to the non-paper conveyance region temperature rise.

Figure 20:
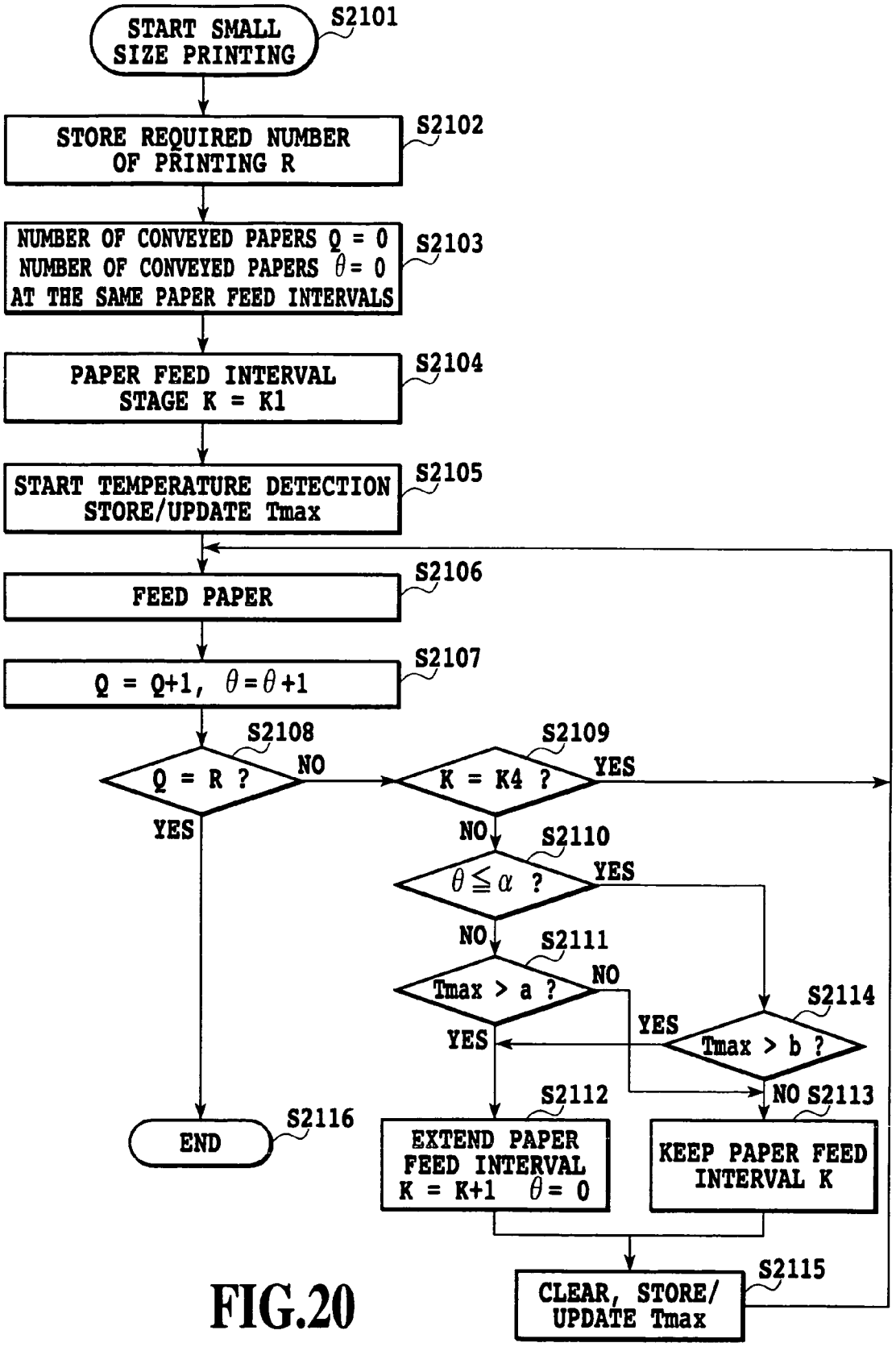
FIG. 20 is a flowchart of the paper feed interval switching control of an embodiment in accordance with the present invention.

FIG. 20 is a flowchart of the paper feed interval switching control of the fourth embodiment. Except for step S2114 of FIG. 20, the flowchart is the same as that of the third embodiment. At step S2110, if θ≦α holds, the maximum value Tmax of the detection temperature of the sub-thermistor is compared with the threshold temperature b (b>a) at step S2114. If Tmax>b holds, the paper feed interval is extended at step S2112. Otherwise, the processing proceeds to step S2113 at which the paper feed interval is not extended.

Such control can achieve the effect similar to that of the third embodiment. In addition, even if an unknown type of paper is conveyed with which the non-paper conveyance region temperature rise is very sharp, or the recording medium undergoes the multi feeding, it is possible to prevent the thermal degradation of the press roller or the image degradation due to the non-paper conveyance region temperature rise by extending the paper feed intervals in two successive stages.

Although the present embodiment sets the specified paper count α at the same value α=2 for the stages K=K2 and K3 of the paper feed intervals, it is also possible to set different values for the individual stages of the paper feed intervals.

Fifth Embodiment

Although the third and fourth embodiments employ the control that extends the paper feed interval stepwise, if the temperature of the non-paper conveyance region falls enough, the paper feed interval can be reduced again. Such control has been proposed in Japanese Patent Application Laid-open No. 2002-169413, for example.

In such control, reducing the paper feed interval to increase the throughput is likely to switch the paper feed interval twice successively as described in the previous section. In this case, the paper feed interval is reduced twice successively.

In view of this, the present embodiment is characterized by setting the number of conveyed papers β during which the reduction of the paper feed interval is inhibited even if the detection temperature T falls below the threshold temperature c immediately after the reduction of the paper feed interval.

Table 7 shows the individual preset values of the paper feed interval switching control of the fifth embodiment.

TABLE 7

Preset Values of Paper Feed Interval Switching Control of Fifth Embodiment.

| | Paper feed interval Stages K | | | |
|---|---|---|---|---|
| | K1 | K2 | K3 | K4 |
| Paper feed intervals | 5 sec | 10 sec | 15 sec | 30 sec |
| Paper count β | undefined | 2 | | 0 |
| Threshold temperature c | 165° C. | | | |

To achieve this, the present embodiment counts the paper count θ of the successive paper conveyance at the same paper feed interval, presets the specified paper count β for the paper count θ, and sets the specified paper count β=0 in the stage of the paper feed interval K1 in the initial paper conveyance.

Figure 21:
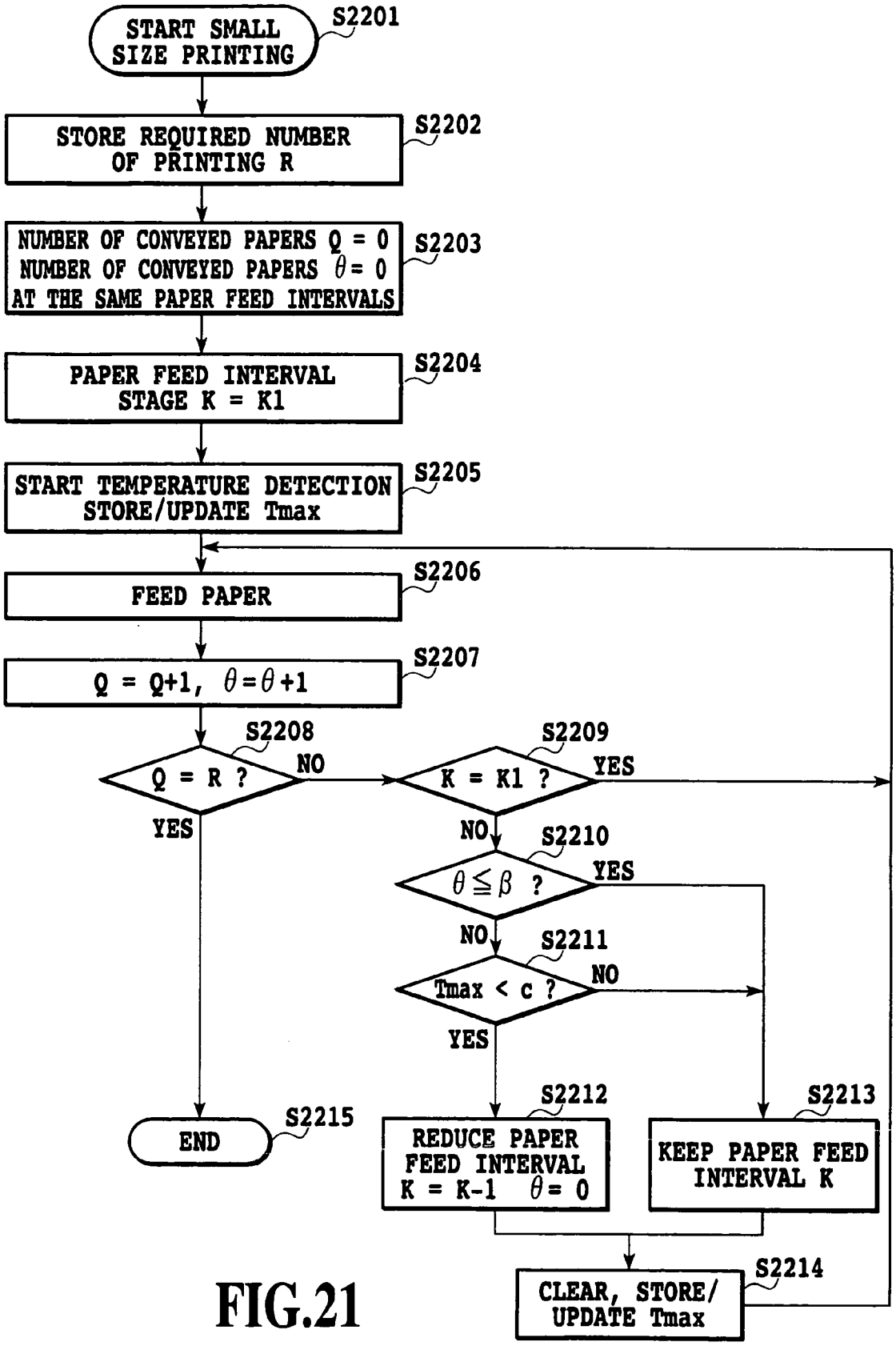
FIG. 21 is a flowchart of the paper feed interval switching control of an embodiment in accordance with the present invention.

FIG. 21 is a flowchart of the paper feed interval switching control of the fifth embodiment. Steps S2201-S2209 are the same as their counterparts of the embodiment 1. If the paper count θ of the papers conveyed at the same paper feed interval is greater than the specified paper count β at step S2210, the maximum temperature Tmax of the detection temperature is compared with the threshold temperature c at step S2211. If Tmax<c holds, the paper feed interval is reduced at step S2212. If Tmax<c does not hold, the paper feed interval is not reduced (step S2213). If θ≦β holds at step S2210, the paper feed interval is not reduced (step S2213).

The subsequent control is the same as that of the third embodiment.

Although the present embodiment sets the specified paper count β at the same value β=2 for the stages K=K2 and K3 of the paper feed intervals, it is also possible to set different values for the individual stages of the paper feed intervals.

Sixth Embodiment

As for the specified paper count β after reducing the paper feed interval in the embodiment 5, it is a value for the control during which the paper feed interval is not switched regardless of the threshold temperature c. However, it is possible to set a threshold temperature d (d<c) that differs from the threshold temperature c and is used during the paper conveyance of the specified paper count β, in order to reduce the paper feed intervals twice successively, if the detection temperature is lower than the threshold temperature d.

Table 8 shows the individual preset values of the paper feed interval switching control of the sixth embodiment. The specified paper count β and threshold temperature c are set as in the third embodiment.

TABLE 8

Preset Values of Paper Feed Interval Switching Control of Sixth Embodiment.

| | Paper feed interval Stages K | | | |
|---|---|---|---|---|
| | K1 | K2 | K3 | K4 |
| Paper feed intervals | 5 sec | 10 sec | 15 sec | 30 sec |
| Paper count β | undefined | 2 | | 0 |
| Threshold temperature c at θ > β | | | 165° C. | |
| Threshold temperature d at θ ≦ β | | | 160° C. | |

The threshold temperature d is set as follows. First, it is determined such as d<c. Second, it is set such that even when the paper feed intervals are reduced twice successively, the temperature of the press roller does not reach the thermal degradation temperature, or the image degradation due to the non-paper conveyance region temperature rise does not occur.

Figure 22:
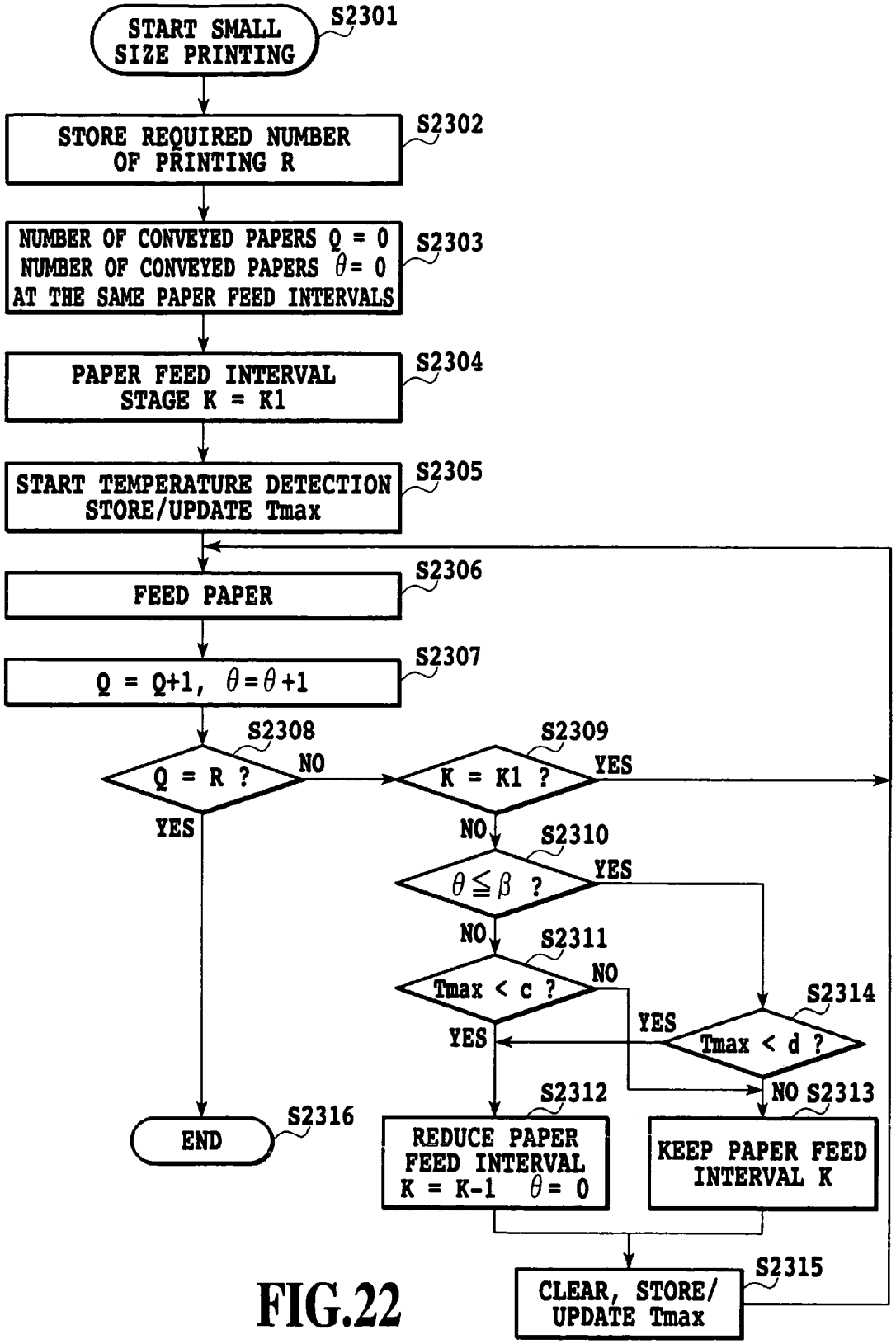
FIG. 22 is a flowchart of the paper feed interval switching control of an embodiment in accordance with the present invention.

FIG. 22 is a flowchart of the paper feed interval switching control of the sixth embodiment. Except for step S2314 of FIG. 22, the flowchart is the same as that of the fifth embodiment. At step S2310, if θ≦β holds, the maximum value Tmax of the detection temperature of the sub-thermistor is compared with the threshold temperature d (d<c) at step S2314. If Tmax<d holds, the paper feed interval is reduced at step S2312. Otherwise, the processing proceeds to step S2313 at which the paper feed interval is not changed.

Although the present embodiment sets the specified paper count β at the same value β=2 for the stages K=K2 and K3 of the paper feed intervals, it is also possible to set different values for the individual stages of the paper feed intervals.

Seventh Embodiment

The third and fourth embodiments provide the control that solves the problem of the control of extending the paper feed intervals, and the fifth and sixth embodiments provide the control that solves the problem of the control of reducing the paper feed intervals. The third and fourth embodiment, however, can have the control of one of the fifth and sixth embodiments.

Figure 23A:
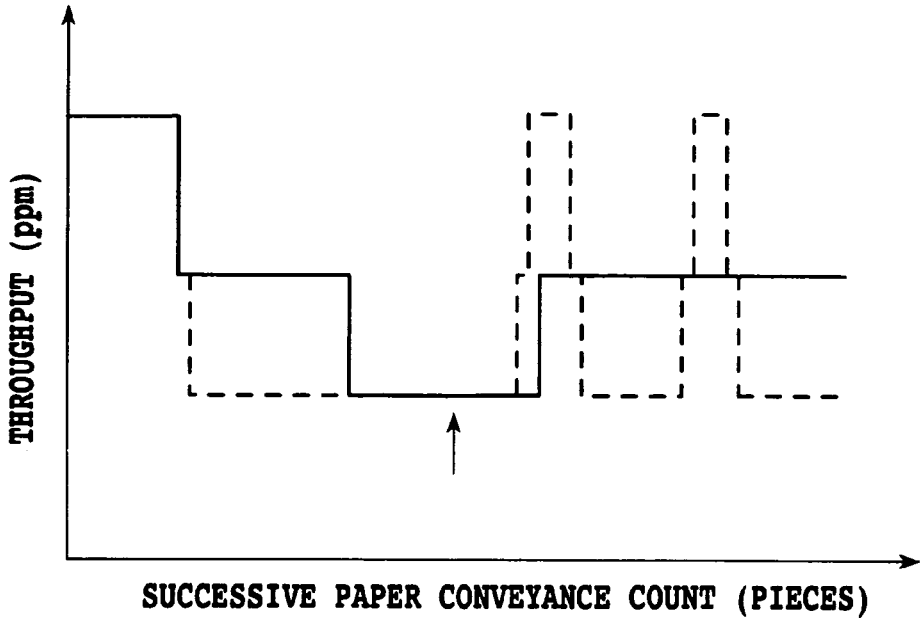
FIGS. 23A and 23B are diagrams illustrating an effect 2 of an embodiment in accordance with the present invention.
Figure 23B:
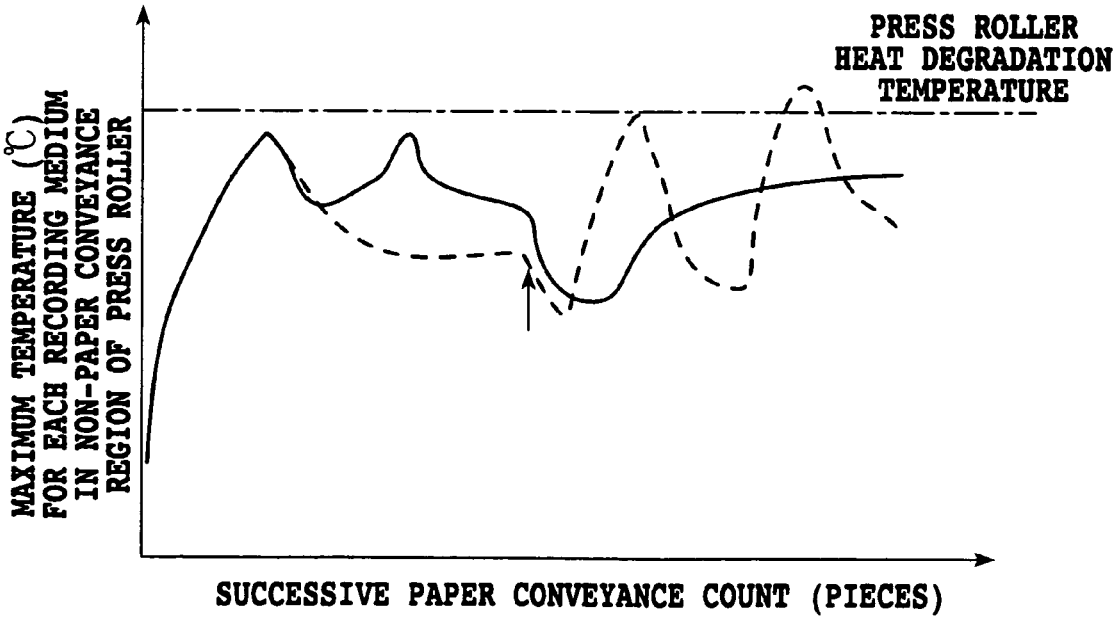

FIGS. 23A and 23B illustrate an effect of such control. In this example, after the successive paper conveyance of the COM10 envelopes and the extension of the paper feed interval, the successive paper conveyance is carried out of EXE size recording mediums with which the non-paper conveyance temperature rise is rather mild (the switching time is indicated by the arrow in FIGS. 23A and 23B). FIG. 23A illustrates the changes of the throughput during the successive paper conveyance; and FIG. 23B illustrates the maximum temperature of the non-paper conveyance region of the press roller for each recording medium. The solid lines represent the behavior of the paper feed interval switching control of the present embodiment, and the broken lines represent that of the conventional temperature switching control. The paper conveyance of the EXE size recording mediums reduces the temperature of the non-paper conveyance region of the press roller. After the press roller temperature falls considerably, the control of reducing the paper feed intervals is performed. In the conventional example, the paper feed intervals are reduced twice successively so that the sharp temperature rise occurs, and hence the temperature of the press roller can sometimes exceed its thermal degradation temperature.

In contrast with this, the present embodiment avoids switching the paper feed intervals successively. Thus, it can carry out the successive paper conveyance in the stable temperature condition in the non-paper conveyance region of the press roller. In this way, the present embodiment can increase the throughput with preventing the temperature of the non-paper conveyance region of the press roller from reaching the thermal degradation temperature.

Eighth Embodiment

The control of halting the heater 73 if the detection temperature T of the sub-thermistor 76 reaches a very high temperature is actually used. The temperature of the heater can reach a very high level if the temperature of the non-paper conveyance region is increased because of the double transport of the recording mediums, or if the temperature control of the heater faults because of malfunction of the temperature detection by the main thermistor 75 or of the control means. The control serves to prevent the thermal degradation of the fusing apparatus, the damage of the heater, or the occurrence of a fire. In such a failure, it is safer to halt the heater regardless of the threshold temperature or the number of conveyed papers. In view of this, the present embodiment is characterized by halting the heater regardless of the specified paper counts α and β if a threshold temperature e (e>a, b, c and d) for detecting the abnormal temperature is detected in the third to seventh embodiments of the image generating apparatus.

Table 9 shows the individual preset values of the paper feed interval switching control of the eighth embodiment.

TABLE 9

Preset Values of Paper Feed Interval Switching Control of Eighth Embodiment.

| | Paper feed interval Stages K | | | |
|---|---|---|---|---|
| | K1 | K2 | K3 | K4 |
| Paper feed intervals | 5 sec | 10 sec | 15 sec | 30 sec |
| Paper count α | 0 | 2 | | undefined |
| Threshold temperature a at θ > β | | 210° C. | | |
| Threshold temperature b at θ ≦ β | | 220° C. | | |
| threshold temperature e | | 230° C. | | |

The control adds the threshold temperature e (e>a and b) for halting the heater to the control of the fourth embodiment.

Figure 24:
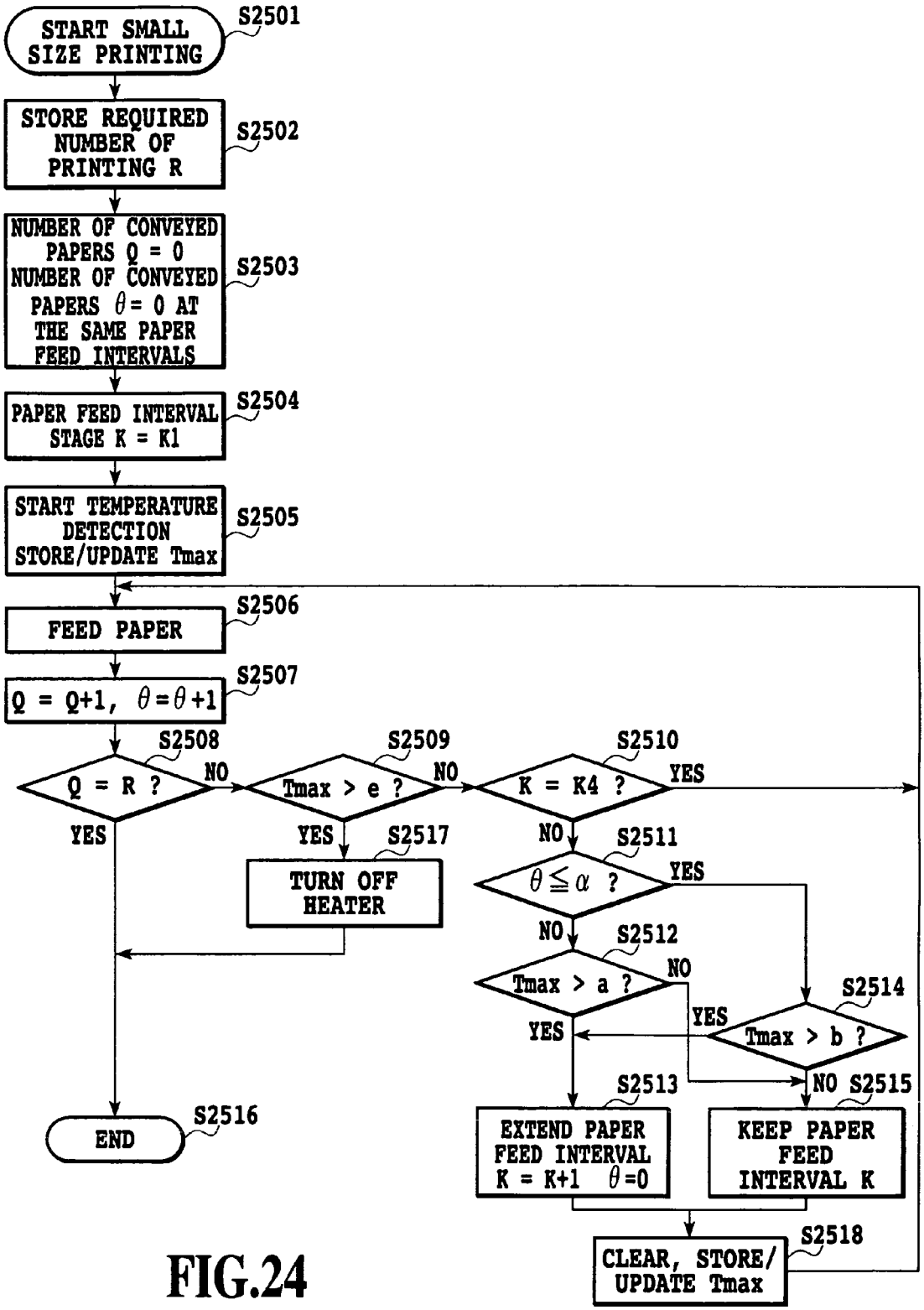
FIG. 24 is a flowchart of the paper feed interval switching control of an embodiment in accordance with the present invention.

FIG. 24 is a flowchart of the paper feed interval switching control of the eighth embodiment. Except for step S2509 of FIG. 24, the flowchart is the same as that of the fourth embodiment. At step S2509, if the maximum value Tmax of the detection temperature becomes Tmax>e, the heater is turned off regardless of the specified paper count α, and the entire control is stopped (step S2517).

Although the present embodiment is an example that adds the threshold temperature e to the fourth embodiment, the threshold temperature e can be added to any one of the third to seventh embodiments. Thus, the same object can be achieved by incorporating the control of tuning off the heater regardless of the paper counts α and β if the condition of Tmax>e takes place.

As described in the third to eighth embodiments, the specified paper count α or β is set as in the third and fifth embodiments, and the control is carried out of maintaining the paper feed intervals of the paper conveyance during the specified paper count α or β after switching the paper feed interval. Thus, the control can be implemented of preventing the successive extension of the paper feed intervals even in the control where the paper feed interval is so short that a decision is made as to the switching of the paper feed interval of the subsequent paper, before the rear edge of the previous paper has not yet left the fusing nip completely.

Alternatively, providing the threshold temperature b different from the normal threshold temperature a (b>a) for the specified paper count α as in the fourth embodiment enables the following control. When the temperature rise in the non-paper conveyance region is very large as when the recording mediums with the very severe non-paper conveyance region temperature rise are conveyed, or the recording mediums undergo the multi feeding, the paper feed intervals can be extended twice successively.

Alternatively, providing the threshold temperature d different from the normal threshold temperature c (d<c) for the specified paper count β as in the fifth to seventh embodiments enables the following control. When the temperature rise in the non-paper conveyance region is small, or when the recording mediums with the mild non-paper conveyance region temperature rise are conveyed in the middle of the successive paper conveyance, the control is implemented which can prevent the successive reduction in the paper feed intervals.

As a result, the embodiments can achieve the increase in the throughput with preventing the thermal degradation of the components of the fusing apparatus such as the press roller, or the image degradation due to the non-paper conveyance temperature rise.

In addition, determining the specified paper counts α and β, and the threshold temperature e as in the eighth embodiment makes it possible to detect the abnormally high temperature of the heater, and to prevent the thermal degradation of the fusing apparatus, the damage of the heater, or the occurrence of a fire by turning off the current supply to the heater regardless of the specified paper counts α and β.

It is obvious that the structure of the ceramic heater 73 as the heating body is not limited to that described in the embodiments. In addition, the heating body is not limited to the ceramic heater.

As for the fusing film 72, it is not limited to the cylindrical film as shown in the embodiments. An endless belt type, which is looped over a plurality of supporting components to be rotated, is conveyed with being unreeled from a roll of a long web-like film with an end.

In addition, the film heat type fusing apparatus is not limited to the press roller driving type as in the foregoing embodiments. For example, the apparatus is also possible which drives the film so that the press roller is driven by the film.

Furthermore, the fusing means in accordance with the present invention can include a provisional fusing apparatus for provisionally fusing an unfused image on a recording medium, and an image heating apparatus for reheating the recording medium bearing the fused image to reform its image surface property such as gloss. The configuration and control of the apparatus in accordance with the present invention is effectively applicable to these apparatuses.

Examples in accordance with the present invention will now be enumerated below.

EXAMPLE 1

An image generating apparatus comprising:

fusing means including a heating body disposed in a longitudinal direction perpendicular to a conveyance direction of a recording medium, a film sliding on the heating body, and a pressing component for forming a nip by press-contacting the heating body via the film, the fusing means introducing a recording medium bearing an unfused toner image between the film and the pressing component at the nip to be pinched and transported, and fusing the toner image onto the recording medium by heating the toner image by the heat of the heating body via the film;

first temperature detecting means disposed at a location in a paper conveyance region of any conveyable recording mediums, for detecting temperature of the heating body;

second temperature detecting means disposed at a location in a non-paper conveyance region through which a narrow-width recording medium does not pass during paper conveyance;

means for counting the number of conveyed recording mediums;

current supply control means for controlling current supply to the heating body in response to the temperature detected by the first temperature detecting means; and control means having a threshold temperature preset for the temperature T detected by the second temperature detecting means, for extending paper feed intervals when the detection temperature T exceeds the threshold temperature, wherein the image generating apparatus includes a control mode that sets a specified paper count α, and prevents the extension of the paper feed intervals for the paper conveyance during the specified paper count α.

EXAMPLE 2

The image generating apparatus as described in Example 1, wherein the threshold temperature of the detection temperature T is set at a, and wherein the image generating apparatus includes a control mode in which the specified paper count α is the number of conveyed papers counted from the recording medium next to the recording medium at which the detection temperature T exceeds the threshold temperature a.

EXAMPLE 3

An image generating apparatus comprising:

fusing means including a heating body disposed in a longitudinal direction perpendicular to a conveyance direction of a recording medium, a film sliding on the heating body, and a pressing component for forming a nip by press-contacting the heating body via the film, the fusing means introducing a recording medium bearing an unfused toner image between the film and the pressing component at the nip to be pinched and transported, and fusing the toner image onto the recording medium by heating the toner image by the heat of the heating body via the film;

means for counting the number of conveyed recording mediums;

current supply control means for controlling current supply to the heating body in response to the temperature detected by the first temperature detecting means; and control means having a threshold temperature preset for the temperature T detected by the second temperature detecting means, for extending paper feed intervals when the detection temperature T exceeds the threshold temperature, wherein the image generating apparatus includes a control mode that usually sets the threshold temperature at the normal threshold temperature a, and that presets a specified paper count α, and sets the threshold temperature at temperature b different from the normal threshold temperature a (b>a) in the paper conveyance during the specified paper count α.

EXAMPLE 4

The image generating apparatus as described in Example 3, wherein the image generating apparatus includes a control mode in which the specified paper count α is the number of conveyed papers counted from the recording medium next to the recording medium at which the detection temperature T exceeds the threshold temperature a or b.

EXAMPLE 5

An image generating apparatus comprising:

fusing means including a heating body disposed in a longitudinal direction perpendicular to a conveyance direction of a recording medium, a film sliding on the heating body, and a pressing component for forming a nip by press-contacting the heating body via the film, the fusing means introducing a recording medium bearing an unfused toner image between the film and the pressing component at the nip to be pinched and transported, and fusing the toner image onto the recording medium by heating the toner image by the heat of the heating body via the film;

means for counting the number of conveyed recording mediums;

current supply control means for controlling current supply to the heating body in response to the temperature detected by the first temperature detecting means; and control means having a threshold temperature preset for the temperature T detected by the second temperature detecting means, for reducing paper feed intervals when the detection temperature T falls below the threshold temperature, wherein the image generating apparatus includes a control mode that sets a specified paper count β, and prevents the reduction of the paper feed intervals for the paper conveyance during the specified paper count β.

EXAMPLE 6

The image generating apparatus as described in Example 5, wherein the threshold temperature of the detection temperature T is set at c, and wherein the image generating apparatus includes a control mode in which the specified paper count β is the number of conveyed papers counted from the recording medium next to the recording medium at which the detection temperature T falls below the threshold temperature c.

EXAMPLE 7

An image generating apparatus comprising:

fusing means including a heating body disposed in a longitudinal direction perpendicular to a conveyance direction of a recording medium, a film sliding on the heating body, and a pressing component for forming a nip by press-contacting the heating body via the film, the fusing means introducing a recording medium bearing an unfused toner image between the film and the pressing component at the nip to be pinched and transported, and fusing the toner image onto the recording medium by heating the toner image by the heat of the heating body via the film;

means for counting the number of conveyed recording mediums;

current supply control means for controlling current supply to the heating body in response to the temperature detected by the first temperature detecting means; and control means having a threshold temperature preset for the temperature T detected by the second temperature detecting means, for reducing paper feed intervals when the detection temperature T falls below the threshold temperature, wherein the image generating apparatus includes a control mode that usually sets the threshold temperature at the normal threshold temperature c, and that presets a specified paper count β, and switches the threshold temperature to temperature d different from the normal threshold temperature c (d<c) in the paper conveyance during the specified paper count β.

EXAMPLE 8

The image generating apparatus as described in Example 7, wherein the image generating apparatus includes a control mode in which the specified paper count β is the number of conveyed papers counted from the recording medium next to the recording medium at which the detection temperature T falls below the threshold temperature c or d.

EXAMPLE 9

The image generating apparatus including the control mode as described in Example 2 or 4, and the control mode as described in Example 6 or 8.

EXAMPLE 10

The image generating apparatus as described in any one of Examples 1-9, wherein the film of the fusing means is a rotator.

Incidentally, it is obvious that the present invention can be implemented by providing the system or apparatus with a storing medium that stores the program code of software for achieving the functions of the foregoing embodiments, and by reading and executing the program code stored in the storing medium with a computer (or CPU or MPU) of the system or apparatus.

In this case, the program code itself read from the storing medium implements the novel functions of the present invention, and the storing medium that stores the program code constitutes the present invention.

As the storing medium for providing the program code, various media can be used such as a floppy disk, hard disk, magneto-optical disk, optical disk, CD-ROM, CD-R, magnetic tape, nonvolatile memory card, and ROM.

The functions of the foregoing embodiments are implemented by executing the program code read by the computer. In addition, an operating system or the like running on the computer under the control of the program code can carry out part or all of the actual processing, thereby implementing the functions of the foregoing embodiments.

Furthermore, it is also possible that the program code read from the storing medium is once written into a memory of a function expansion board inserted into the computer or of a function expansion unit connected to the computer, and that the computer installed in the function expansion board or function expansion unit executes part or all of the actual processing under the control of the program code, thereby implementing the functions of the foregoing embodiments.

As a matter of course, the present invention is also applicable to the case where the program is delivered to a user from a storing medium recording the program code of the software implementing the functions of the foregoing embodiments via a communication line such as a personal computer communication.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An image forming apparatus for forming an image on a recording medium, said image forming apparatus comprising:

an image forming section for forming a toner image on a recording medium;

a fusing section for fixing the toner image onto the recording medium, said fusing section including a heating component, a pressing component which forms a nip portion for nipping and conveying the recording medium in conjunction with said heating component, a first temperature detecting element for detecting a temperature of said heating component within a conveyance area of a predetermined smallest recording medium usable for said apparatus, and a second temperature detecting element for detecting a temperature of said heating component outside the conveyance area of the predetermined smallest recording medium usable for said apparatus;

a temperature control section for controlling an electrical power supply to said heating component so that the temperature detected by said first temperature detecting element is maintained at a target temperature; and a feeding interval control section for controlling feeding interval of the recording mediums, said feeding interval control section controls so as to expand the feeding interval of the recording mediums when a temperature detected by said second temperature detecting element reaches a threshold temperature, wherein, during successive printing, after the temperature detected by said second temperature detecting element reaches the threshold temperature, said feeding interval control section disables further expanding the feeding interval regardless of the temperature detected by said second temperature detecting element during the printing of a prescribed number of prints.

2. An image forming apparatus for forming an image on a recording medium, said image forming apparatus comprising:

an image forming section for forming a toner image on a recording medium;

a fusing section for fixing the toner image onto the recording medium, said fusing section including a heating component, a pressing component which forms a nip portion for nipping and conveying the recording medium in conjunction with said heating component, a first temperature detecting element for detecting a temperature of said heating component within a conveyance area of a predetermined smallest recording medium usable for said apparatus, and a second temperature detecting element for detecting a temperature of said heating component outside the conveyance area of the predetermined smallest recording medium usable for said apparatus;

a temperature control section for controlling an electrical power supply to said heating component so that the temperature detected by said first temperature detecting element is maintained at a target temperature; and a feeding interval control section for controlling feeding interval of the recording mediums, said feeding interval control section controls so as to expand the feeding interval of the recording mediums when a temperature detected by said second temperature detecting element reaches a threshold temperature, wherein, during successive printing, after the temperature detected by said second temperature detecting element reaches a first threshold temperature, said feeding interval control section sets the threshold temperature to a second threshold temperature higher than the first threshold temperature during the printing of a prescribed number of prints.

3. The image forming apparatus as claimed in claim 2, wherein, during successive printing, said feeding interval control section resets the threshold temperature from the second threshold temperature to the first threshold temperature after a completion of the printing of a prescribed number of prints.

* * * * *

UNITED STATES PATENT AND TRADEMARK OFFICE

CERTIFICATE OF CORRECTION

PATENT NO. : 7,257,342 B2
APPLICATION NO. : 11/407040
DATED : August 14, 2007
INVENTOR(S) : Akira Hayakawa et al.

It is certified that error appears in the above-identified patent and that said Letters Patent is hereby corrected as shown below:

COLUMN 1:
Line 4, “NMOS.” should read --Nos.--.
Line 18, ““fusser”)” should read --“fuser”)--.

COLUMN 2:
Line 4, “ETC” should read --NTC--.
Line 8, “ETC” should read --NTC--.

COLUMN 5:
Line 30, “take” should read --taken--.

COLUMN 10:
Line 36, “body,” should read --body, to--.
Line 53, “ETC” should read --NTC--.

COLUMN 11:
Line 9, “ETC” should read --NTC--.
Line 52, “T4=250°C.” should read --T4=235°C.--

COLUMN 15:
Line 13, “subsequently” should read --subsequent--.

COLUMN 16:
Line 28, “controling” should read --controlling--.
Line 56, “not shown” should read --(not shown)--.

COLUMN 18:
Line 43, “impossible” should read --it possible--.

COLUMN 23:
Line 21, “a sheets” should read --α sheets--.
Line 55, “then umber” should read --the number--.

COLUMN 28:
Line 65, “tuning” should read --turning--.

UNITED STATES PATENT AND TRADEMARK OFFICE

CERTIFICATE OF CORRECTION

PATENT NO. : 7,257,342 B2
APPLICATION NO. : 11/407040
DATED : August 14, 2007
INVENTOR(S) : Akira Hayakawa et al.

It is certified that error appears in the above-identified patent and that said Letters Patent is hereby corrected as shown below:

COLUMN 29:
Line 11, "not yet" should be deleted.

Signed and Sealed this

Fifteenth Day of April, 2008

JON W. DUDAS
*Director of the United States Patent and Trademark Office*

UNITED STATES PATENT AND TRADEMARK OFFICE

CERTIFICATE OF CORRECTION

PATENT NO. : 7,257,342 B2
APPLICATION NO. : 11/407040
DATED : June 6, 2006
INVENTOR(S) : Aoki et al.

It is certified that error appears in the above-identified patent and that said Letters Patent is hereby corrected as shown below:

IN THE CLAIMS

Claim 1, Column 21, line 23, "$MO_2$ is manganese oxide" should read --$MO_2$ is manganese (IV) oxide--

Claim 17, Column 22, line 27, "$MO_2$ is manganese oxide" should read --$MO_2$ is manganese (IV) oxide--

Signed and Sealed this

Ninth Day of June, 2009

JOHN DOLL
*Acting Director of the United States Patent and Trademark Office*

UNITED STATES PATENT AND TRADEMARK OFFICE

CERTIFICATE OF CORRECTION

PATENT NO. : 7,257,342 B2
APPLICATION NO. : 11/407040
DATED : August 14, 2007
INVENTOR(S) : Akira Hayakawa et al.

It is certified that error appears in the above-identified patent and that said Letters Patent is hereby corrected as shown below:

This certificate supersedes the Certificate of Correction issued June 9, 2009. The certificate should be vacated since corrections displayed on 1050 does not correspond to text location in printed patent.

Signed and Sealed this

Seventh Day of July, 2009

JOHN DOLL
*Acting Director of the United States Patent and Trademark Office*